US010698359B2

(12) United States Patent
Fujita et al.

(10) Patent No.: US 10,698,359 B2
(45) Date of Patent: Jun. 30, 2020

(54) IMAGE FORMING APPARATUS AND IMAGE FORMING METHOD

(71) Applicant: KYOCERA Document Solutions Inc., Osaka (JP)

(72) Inventors: Toshiki Fujita, Osaka (JP); Ikuo Makie, Osaka (JP); Masahito Ishino, Osaka (JP); Nariaki Tanaka, Osaka (JP); Kiyotaka Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/505,877

(22) Filed: Jul. 9, 2019

(65) Prior Publication Data

US 2020/0041950 A1 Feb. 6, 2020

(30) Foreign Application Priority Data

Jul. 31, 2018 (JP) ..... 2018-143072

(51) Int. Cl.

| | |
|---|---|
| ***G03G 5/00*** | (2006.01) |
| ***G03G 21/08*** | (2006.01) |
| ***G03G 5/047*** | (2006.01) |
| ***G03G 5/05*** | (2006.01) |
| ***G03G 5/06*** | (2006.01) |
| ***G03G 21/16*** | (2006.01) |

(52) U.S. Cl.

CPC ..... *G03G 21/08* (2013.01); *G03G 5/047* (2013.01); *G03G 5/0546* (2013.01); *G03G 5/0609* (2013.01); *G03G 5/0614* (2013.01); *G03G 5/0696* (2013.01); *G03G 21/168* (2013.01)

(58) Field of Classification Search

CPC ..... G03G 21/08; G03G 5/0696
USPC ..... 430/125.2
See application file for complete search history.

(56) References Cited

U.S. PATENT DOCUMENTS

2010/0224877 A1* 9/2010 Ishii ..... C23C 16/24 257/53

FOREIGN PATENT DOCUMENTS

JP 2001-350329 A 12/2001

* cited by examiner

*Primary Examiner* — Mark A Chapman
(74) *Attorney, Agent, or Firm* — Studebaker & Brackett PC

(57) ABSTRACT

An image forming apparatus includes an image bearing member and a static elimination device. The static elimination device irradiates static elimination light onto a circumferential surface of the image bearing member. The image bearing member includes a conductive substrate and a single-layer photosensitive layer. The photosensitive layer contains a charge generating material, a hole transport material, an electron transport material, and a binder resin. The static elimination light has a wavelength of at least 600 nm and no greater than 800 nm. The photosensitive layer has an optical absorption coefficient of at least 600 $cm^{-1}$ and no greater than 1,500 $cm^{-1}$ with respect to light having a wavelength of 660 nm.

11 Claims, 8 Drawing Sheets

IMAGE FORMING APPARATUS AND IMAGE FORMING METHOD

INCORPORATION BY REFERENCE

The present application claims priority under 35 U.S.C. § 119 to Japanese Patent Application No. 2018-143072, filed on Jul. 31, 2018. The contents of this application are incorporated herein by reference in their entirety.

BACKGROUND

The present disclosure relates to an image forming apparatus and an image forming method.

In recent years, it has been desired to perform high-speed printing using an electrophotographic image forming apparatus. In high-speed printing, however, charge trapped in a photosensitive layer may cause an image defect (for example, a ghost image due to a phenomenon called image memory). Various studies have been made in order to inhibit occurrence of such an image defect. For example, a known electrostatic printing apparatus satisfies the following relationship between a wavelength $\lambda_0$ of light from an irradiation light source for latent image formation and a wavelength $\lambda_1$ of static elimination light that is emitted after development: $\lambda_0-200\text{ nm}\leq\lambda_1\leq780\text{ nm}$.

SUMMARY

An image forming apparatus according to an aspect of the present disclosure includes an image bearing member and a static elimination device. The static elimination device irradiates static elimination light onto a circumferential surface of the image bearing member. The image bearing member includes a conductive substrate and a single-layer photosensitive layer. The single-layer photosensitive layer contains a charge generating material, a hole transport material, an electron transport material, and a binder resin. The static elimination light has a wavelength of at least 600 nm and no greater than 800 nm. The single-layer photosensitive layer has an optical absorption coefficient of at least 600 $cm^{-1}$ and no greater than 1,500 $cm^{-1}$ with respect to light having a wavelength of 660 nm.

A method for forming an image according to another aspect of the present disclosure includes irradiating static elimination light onto a circumferential surface of an image bearing member. The image bearing member includes a conductive substrate and a single-layer photosensitive layer. The single-layer photosensitive layer contains a charge generating material, a hole transport material, an electron transport material, and a binder resin. The static elimination light has a wavelength of at least 600 nm and no greater than 800 nm. The single-layer photosensitive layer has an optical absorption coefficient of at least 600 $cm^{-1}$ and no greater than 1,500 $cm^{-1}$ with respect to light having a wavelength of 660 nm.

DETAILED DESCRIPTION

Figure 1:
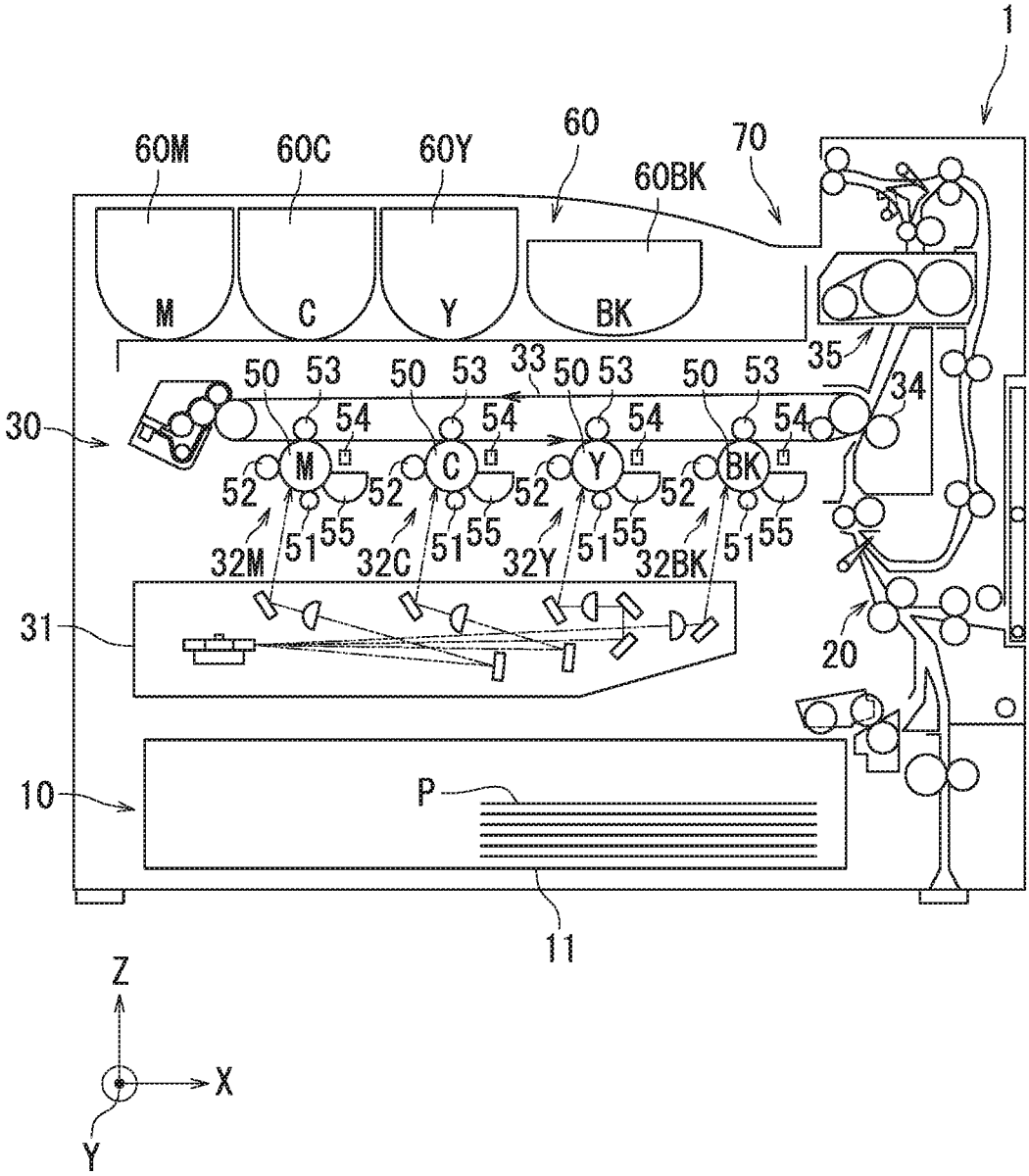
FIG. 1 is a cross-sectional view of an image forming apparatus according to an embodiment of the present disclosure.

The following first describes terms used in the present specification. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, and an alkoxy group having a carbon number of at least 1 and no greater than 4 each refer to the following, unless otherwise stated.

Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein each refer to an unsubstituted straight chain or branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 6 are examples of the alkyl group having a carbon number of at least 1 and no greater than 6, the chemical groups having a carbon number of at least 1 and no greater than 5 are examples of the alkyl group having a carbon number of at least 1 and no greater than 5, the chemical groups having a carbon number of at least 1 and no greater than 4 are examples of the alkyl group having a carbon number of at least 1 and no greater than 4, and the chemical groups having a carbon number of at least 1 and no greater than 3 are examples of the alkyl group having a carbon number of at least 1 and no greater than 3.

An alkoxy group having a carbon number of at least 1 and no greater than 4 as used herein refers to an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group. Through the above, terms used in the present specification have been described.

[Image Forming Apparatus]

The following describes an embodiment of the present disclosure with reference to the accompanying drawings. Elements in the drawings that are the same or equivalent are marked by the same reference signs and description thereof is not repeated. In the present embodiment, an X axis, a Y axis, and a Z axis are perpendicular to one another. The X axis and the Y axis are parallel with a horizontal plane, and the Z axis is parallel with a vertical line.

Figure 2:
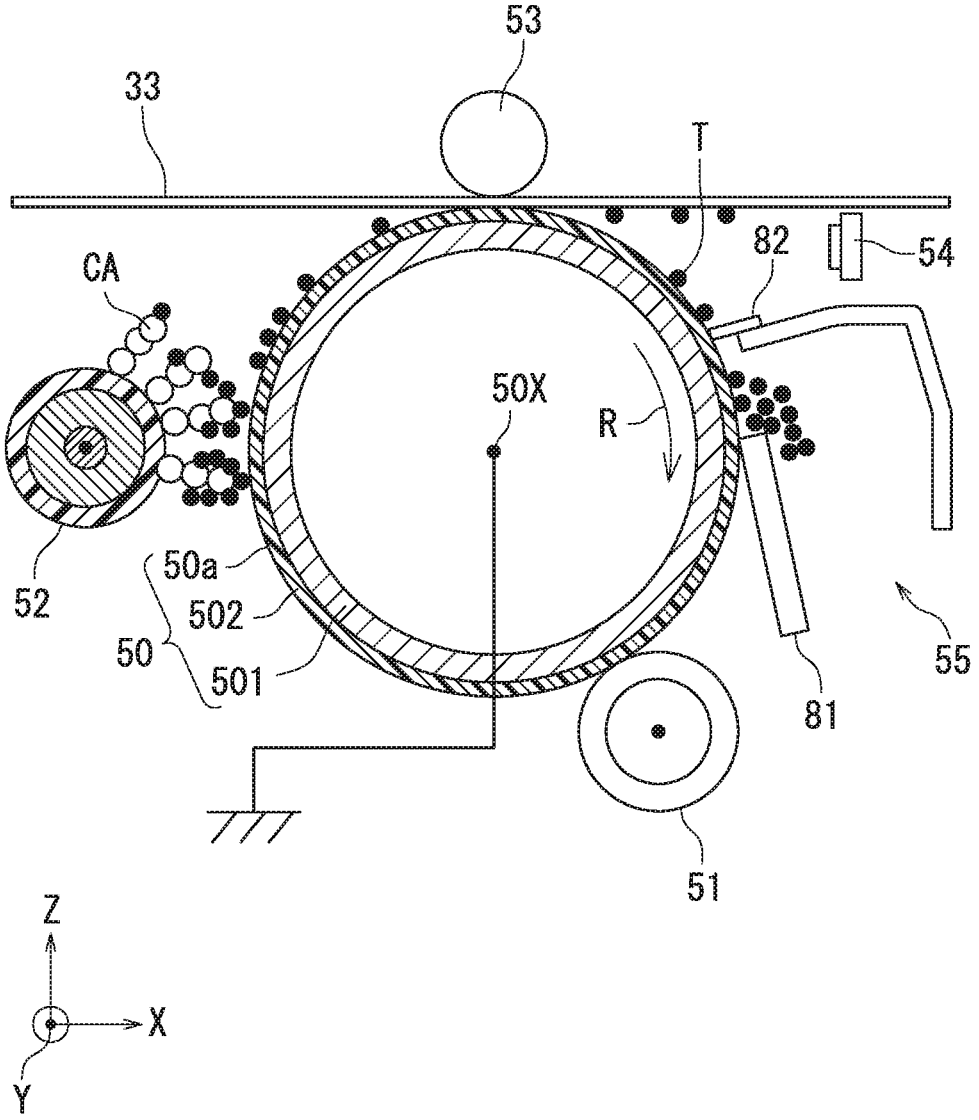
FIG. 2 is a diagram illustrating an image bearing member included in the image forming apparatus illustrated in FIG. 1 and elements around the image bearing member.

The following first describes an overview of an image forming apparatus 1 according to the present embodiment with reference to FIGS. 1 and 2. FIG. 1 is a cross-sectional view of the image forming apparatus 1 according to the present embodiment. FIG. 2 illustrates an electrophotographic photosensitive member (referred to below as a photosensitive member) 50 illustrated in FIG. 1 and elements around the photosensitive member. The image forming apparatus 1 according to the present embodiment is a full-color printer. The image forming apparatus 1 includes a feed section 10, a conveyance section 20, an image forming section 30, a toner supply section 60, and an ejection section 70.

The feed section 10 includes a cassette 11 that accommodates a plurality of sheets P. The feed section 10 feeds a sheet P from the cassette 11 to the conveyance section 20. The sheet P is for example a paper sheet or a synthetic resin sheet. The conveyance section 20 conveys the sheet P to the image forming section 30.

The image forming section 30 includes a light exposure device 31, a magenta unit (referred to below as an M unit) 32M, a cyan unit (referred to below as a C unit) 32C, a yellow unit (referred to below as a Y unit) 32Y, a black unit (referred to below as a BK unit) 32BK, a transfer belt 33, a secondary transfer roller 34, and a fixing device 35. The M unit 32M, the C unit 32C, the Y unit 32Y, and the BK unit 32BK each include a photosensitive member 50, a charging roller 51, a development roller 52, a primary transfer roller 53, a static elimination lamp 54, and a cleaner 55.

The light exposure device 31 irradiates each of the M unit 32M, the C unit 32C, the Y unit 32Y, and the BK unit 32BK with light based on image data to form an electrostatic latent image in each of the M unit 32M, the C unit 32C, the Y unit 32Y, and the BK unit 32BK. The M unit 32M forms a magenta toner image based on the electrostatic latent image. The C unit 32C forms a cyan toner image based on the electrostatic latent image. The Y unit 32Y forms a yellow toner image based on the electrostatic latent image. The BK unit 32BK forms a black toner image based on the electrostatic latent image.

Each photosensitive member 50 is drum-shaped. The photosensitive member 50 rotates about a rotation center 50X (a rotational axis) as illustrated in FIG. 2. The charging roller 51, the development roller 52, the primary transfer roller 53, the static elimination lamp 54, and the cleaner 55 are located around the photosensitive member 50 in the stated order from upstream in a rotation direction R of the photosensitive member 50. The charging roller 51 charges a circumferential surface 50*a* of the photosensitive member 50 to a positive polarity. As already described, the light exposure device 31 irradiates the charged circumferential surface 50*a* of the photosensitive member 50 with light to form an electrostatic latent image on the circumferential surface 50*a* of the photosensitive member 50. The development roller 52 carries a carrier CA supporting a toner T thereon by attracting the carrier CA thereto by magnetic force. A development bias (a development voltage) is applied to the development roller 52 to generate a difference between a potential of the development roller 52 and a potential of the circumferential surface 50*a* of the photosensitive member 50. As a result, the toner T moves and adheres to the electrostatic latent image formed on the circumferential surface 50*a* of the photosensitive member 50. As described above, the development roller 52 supplies the toner T to the electrostatic latent image to develop the electrostatic latent image into a toner image. Thus, the toner image is formed on the circumferential surface 50*a* of the photosensitive member 50. The toner image includes the toner T. The transfer belt 33 is in contact with the circumferential surface 50*a* of the photosensitive member 50. The primary transfer roller 53 performs primary transfer of the toner image from the circumferential surface 50*a* of the photosensitive member 50 to the transfer belt 33 (more specifically, an outer surface of the transfer belt 33). Through the primary transfer, toner images of the four colors are superimposed on one another on the outer surface of the transfer belt 33. The toner images of the four colors are a magenta toner image, a cyan toner image, a yellow toner image, and a black toner image. A color toner image is formed on the outer surface of the transfer belt 33 through the primary transfer. The secondary transfer roller 34 performs secondary transfer of the color toner image from the outer surface of the transfer belt 33 to the sheet P. The fixing device 35 applies heat and pressure to the sheet P to fix the color toner image to the sheet P. The sheet P with the color toner image fixed thereto is ejected by the ejection section 70. After the primary transfer, the static elimination lamp 54 in each of the M unit 32M, the C unit 32C, the Y unit 32Y, and the BK unit 32BK irradiates static elimination light onto the circumferential surface 50*a* of the corresponding photosensitive member 50. Thus, the static elimination lamp 54 eliminates static electricity from the circumferential surface 50*a* of the corresponding photosensitive member 50. After the primary transfer (more specifically, after the primary transfer and the static elimination), the cleaner 55 collects residual toner T on the circumferential surface 50*a* of the photosensitive member 50.

The toner supply section 60 includes a cartridge 60M containing a magenta toner T, a cartridge 60C containing a cyan toner T, a cartridge 60Y containing a yellow toner T, and a cartridge 60BK containing a black toner T. The cartridge 60M, the cartridge 60C, the cartridge 60Y, and the cartridge 60BK respectively supply the toners T to the development rollers 52 of the M unit 32M, the C unit 32C, the Y unit 32Y, and the BK unit 32BK.

Note that the photosensitive member 50 is equivalent to what may be referred to as an image bearing member. The charging roller 51 is equivalent to what may be referred to as a charger. The development roller 52 is equivalent to what may be referred to as a development device. The primary transfer roller 53 is equivalent to what may be referred to as a transfer device. The transfer belt 33 is equivalent to what may be referred to as a transfer target. The static elimination lamp 54 is equivalent to what may be referred to as a static elimination device. The cleaner 55 is equivalent to what may be referred to as a cleaning device. Through the above, the overview of the image forming apparatus 1 according to the present embodiment has been described.

The image forming apparatus 1 according to the present embodiment can inhibit occurrence of a ghost image while ensuring toner transferring performance. The ghost image refers to a phenomenon described as appearance of a residual image along with an output image (an image formed on a sheet P), which in other words is reappearance of an image formed during a previous rotation of the photosensitive member 50. In order to improve toner transferring performance from the photosensitive member 50 to the transfer belt 33, for example, transfer current of the primary transfer roller 53 can be set to a high level. However, the transfer current has an opposite polarity to the charging polarity, and therefore a higher transfer current is more likely to lead to occurrence of a ghost image. In the case of high-speed printing, charge easily remains within the photosensitive layer 502, tending to cause a ghost image. The present inventors therefore made intensive study for the image forming apparatus 1 that is capable of inhibiting occurrence of a ghost image even if the transfer current is set to a high level in order to improve toner transferring performance and high-speed printing is performed. The present inventors then found that it is possible to inhibit occurrence of a ghost image as long as the static elimination light irradiated by the static elimination lamp 54 has a wavelength of at least 600 nm and no greater than 800 nm, and a photosensitive layer 502 (see FIG. 3) has an optical absorption coefficient of at least 600 $cm^{-1}$ and no greater than 1,500 $cm^{-1}$ with respect to light having a wavelength of 660 nm. The following describes the photosensitive member 50 and the static elimination lamp 54.

<Photosensitive Member>

Figure 3:
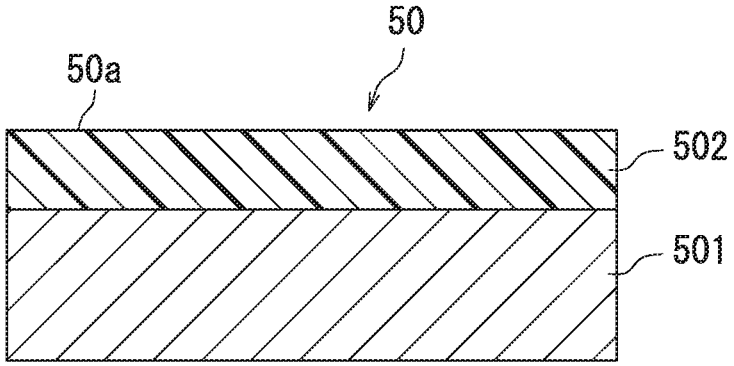
FIG. 3 is a partial cross-sectional view of an example of the image bearing member included in the image forming apparatus illustrated in FIG. 1.
Figure 4:
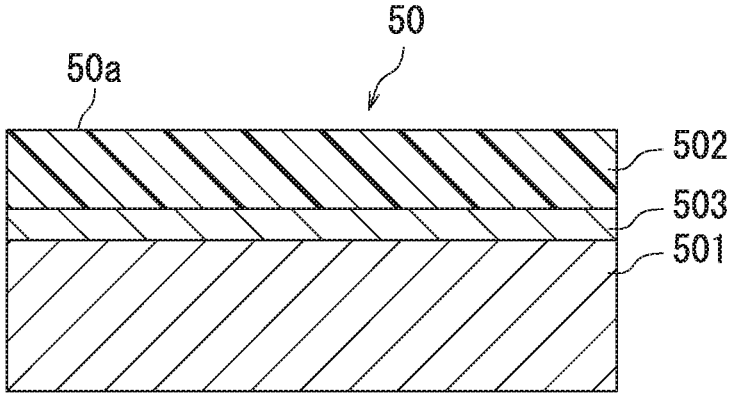
FIG. 4 is a partial cross-sectional view of an example of the image bearing member included in the image forming apparatus illustrated in FIG. 1.
Figure 5:
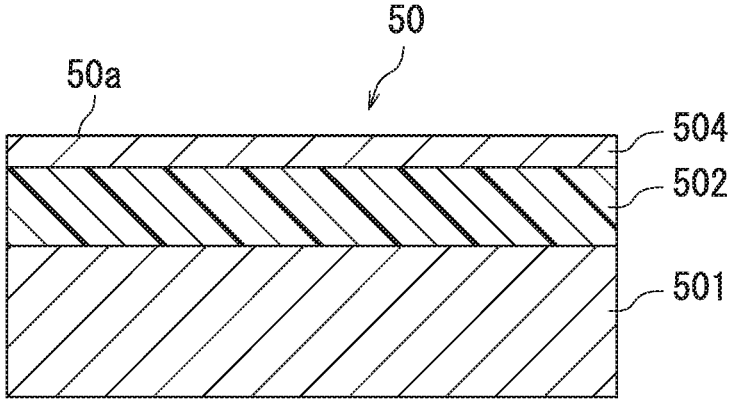
FIG. 5 is a partial cross-sectional view of an example of the image bearing member included in the image forming apparatus illustrated in FIG. 1.

The following describes the photosensitive member 50 of the image forming apparatus 1 with reference to FIGS. 3 to 5. FIGS. 3 to 5 are each a partial cross-sectional view of an example of the photosensitive member 50. The photosensitive member 50 is for example an organic photoconductor (OPC) drum.

As illustrated in FIG. 3, the photosensitive member 50 for example includes a conductive substrate 501 and the photosensitive layer 502. The photosensitive layer 502 is a single-layer (one-layer) photosensitive layer. The photosensitive member 50 is a single-layer electrophotographic photosensitive member including the single-layer photosensitive layer 502. The photosensitive layer 502 contains a charge generating material, a hole transport material, an electron transport material, and a binder resin. No particular limitations are placed on the film thickness of the photosensitive layer 502. The photosensitive layer 502 preferably has a film thickness of at least 5 μm and no greater than 100 μm, more preferably at least 10 μm and no greater than 50 μm, still more preferably at least 10 μm and no greater than 35 μm, and further preferably at least 15 μm and no greater than 30 μm.

The photosensitive member 50 may include an intermediate layer 503 (an undercoat layer) as well as the conductive substrate 501 and the photosensitive layer 502 as illustrated in FIG. 4. The intermediate layer 503 is disposed between the conductive substrate 501 and the photosensitive layer 502. The photosensitive layer 502 may be disposed directly on the conductive substrate 501 as illustrated in FIG. 3. Alternatively, the photosensitive layer 502 may be disposed indirectly on the conductive substrate 501 with the intermediate layer 503 therebetween as illustrated in FIG. 4. The intermediate layer 503 may be a single-layer intermediate layer or a multi-layer intermediate layer.

The photosensitive member 50 may include a protective layer 504 as well as the conductive substrate 501 and the photosensitive layer 502 as illustrated in FIG. 5. The protective layer 504 is disposed on the photosensitive layer 502. The protective layer 504 may be a single-layer protective layer or a multi-layer protective layer.

(Optical Absorption Coefficient)

The optical absorption coefficient of the photosensitive layer 502 with respect to light having a wavelength of 660 nm is at least 600 $cm^{-1}$ and no greater than 1,500 $cm^{-1}$. The "optical absorption coefficient of the photosensitive layer 502 with respect to light having a wavelength of 660 nm" is also referred to below simply as "optical absorption coefficient". The range of "at least 600 $cm^{-1}$ and no greater than 1,500 $cm^{-1}$" is also referred to below simply as "a specified range".

The range of at least 600 $cm^{-1}$ and no greater than 1,500 $cm^{-1}$ is relatively low as the optical absorption coefficient of the photosensitive layer 502. If the optical absorption coefficient is high, the static elimination light is absorbed on or around a surface of the photosensitive layer 502 (a region adjacent to the circumferential surface 50*a* of the photosensitive member 50), making it difficult for the static elimination light to reach a deep region (a region adjacent to the conductive substrate 501) of the photosensitive layer 502. The static elimination light can suitably reach the deep region of the photosensitive layer 502 as long as the optical absorption coefficient is in the specified range. The static elimination light having reached the deep region of the photosensitive layer 502 eliminates charge remaining in the deep region of the photosensitive layer 502. As a result, the circumferential surface 50*a* of the photosensitive member 50 can be uniformly charged when the photosensitive member 50 is re-charged after the static elimination, and thus occurrence of a ghost image is inhibited. Since occurrence of a ghost image can be inhibited, the transfer current (consequently, transfer charge density) of the primary transfer roller 53 can be increased. Thus, it is possible to widen a transfer current setting range possible for the image forming apparatus 1 to inhibit occurrence of a ghost image while ensuring toner transferring performance.

Figure 6:
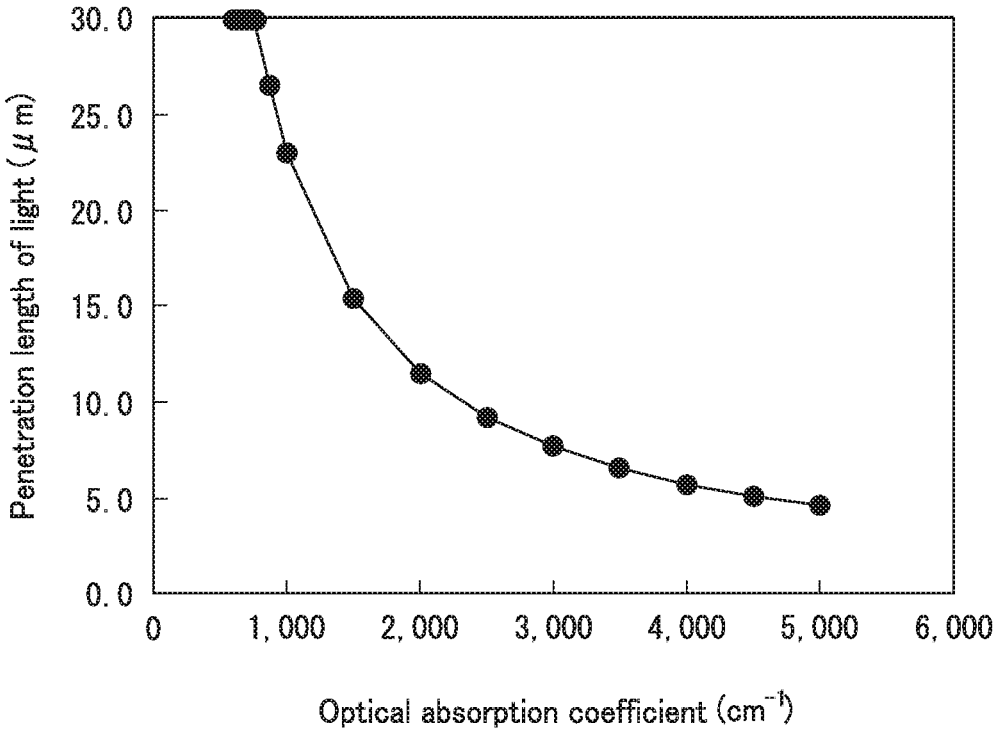
FIG. 6 is a graph representation illustrating a relationship between optical absorption coefficient of a photosensitive layer of the image bearing member and penetration length of light in the photosensitive layer.

The following describes the rationale for the static elimination light to suitably reach the deep region of the photosensitive layer 502 having an optical absorption coefficient within the specified range with reference to FIG. 6. FIG. 6 shows a graph representing a simulation result calculated in accordance with formula (1).

$$\tau=[1/\exp(\alpha_1 \times d)]\times 100 \quad (1)$$

In formula (1), $\tau$ represents a transmittance of the light having a wavelength of 660 nm. $\alpha_1$ represents an optical absorption coefficient with respect to the light having a wavelength of 660 nm, d represents a penetration length (a path length) of the light having a wavelength of 660 nm. The graph shown in FIG. 6 is obtained as described below. Specifically, suppose that the transmittance r of the light having a wavelength of 660 nm irradiated onto the photosensitive layer 502 decreases to 10% as the light is absorbed by the photosensitive layer 502. Then, values of the penetration length d of the light for specific values of the optical absorption coefficient $\alpha_1$ when $\tau$ is 10 ($\tau$=10) are calculated in accordance with formula (1). The optical absorption coefficient $\alpha_1$ (unit: $cm^{-1}$) is plotted on the horizontal axis in FIG. 6, and the calculated penetration length d (unit: μm) of the light is plotted on the vertical axis in FIG. 6. Thus, the graph shown in FIG. 6 is obtained. As shown in FIG. 6, the penetration length d of the light is at least 15.0 μm and no greater than 30.0 μm when the optical absorption coefficient $\alpha_1$ is within the specified range. In the case of the photosensitive layer 502 having a film thickness of 30.0 μm, the light can be determined to have reached the deep region of the photosensitive layer 502 if the penetration length d of the light is at least 15.0 μm and no greater than 30.0 μm.

In order to cause the static elimination light to suitably reach the deep region of the photosensitive layer 502 to inhibit occurrence of a ghost image, the optical absorption coefficient is preferably at least 600 $cm^{-1}$ and no greater than 1,000 $cm^{-1}$, more preferably at least 600 $cm^{-1}$ and no greater than 870 $cm^{-1}$, still more preferably at least 600 $cm^{-1}$ and no greater than 770 $cm^{-1}$, and further preferably at least 600 $cm^{-1}$ and no greater than 700 $cm^{-1}$. The optical absorption coefficient can be measured according to a method described in association with Examples.

The circumferential surface 50*a* of the photosensitive member 50 preferably has a surface friction coefficient of at least 0.2 and no greater than 0.8, and more preferably at least 0.2 and no greater than 0.6. As a result of the surface friction coefficient of the circumferential surface 50*a* of the photosensitive member 50 being no greater than 0.8, adhesion of the toner T to the circumferential surface 50*a* of the photosensitive member 50 is low enough to further prevent insufficient cleaning. As a result of the surface friction coefficient of the circumferential surface 50*a* of the photosensitive member 50 being no greater than 0.8, friction force of the cleaning blade 81 against the circumferential surface 50*a* of the photosensitive member 50 is low enough to further reduce abrasion of the photosensitive layer 502 of the photosensitive member 50. No particular limitations are placed on the lower limit of the surface friction coefficient of the circumferential surface 50*a* of the photosensitive member 50. The surface friction coefficient of the circumferential surface 50*a* of the photosensitive member 50 may for example be at least 0.2.

In order to obtain a high-quality output image, a post-irradiation potential of the circumferential surface 50*a* of the photosensitive member 50 is preferably at least +50 V and no greater than +300 V. and more preferably at least +80 V and no greater than +200 V. The post-irradiation potential is a potential of an irradiated region of the circumferential surface 50*a* of the photosensitive member 50 irradiated with light by the light exposure device 31. The post-irradiation potential is measured before the development and after the light irradiation.

The photosensitive layer 502 preferably has a Martens hardness of at least 150 $N/mm^2$, and more preferably at least 180 $N/mm^2$. As a result of the Martens hardness of the photosensitive layer 502 being at least 150 $N/mm^2$, the abrasion amount of the photosensitive layer 502 is reduced, improving abrasion resistance of the photosensitive member 50. No particular limitations are placed on the upper limit of the Martens hardness of the photosensitive layer 502. For example, the Martens hardness of the photosensitive layer 502 may be no greater than 250 $N/mm^2$.

The photosensitive layer 502 contains a charge generating material, a hole transport material, an electron transport material, and a binder resin. The photosensitive layer 502 may further contain an additive as necessary. The following describes the charge generating material, the hole transport material, the electron transport material, the binder resin, and the additive, and preferable combinations of the materials.

(Charge Generating Material)

The charge generating material is preferably contained in an amount of at least 0.7% by mass and no greater than 1.8% by mass relative to mass of the photosensitive layer 502, more preferably at least 0.7% by mass and no greater than 1.2% by mass, still more preferably at least 0.7% by mass and no greater than 1.0% by mass, further preferably at least 0.7% by mass and no greater than 0.9% by mass, and particularly preferably at least 0.7% by mass and no greater than 0.8% by mass. The amount of the charge generating material being at least 0.7% by mass and no greater than 1.8% by mass relative to the mass of the photosensitive layer 502 is relatively low. A lower amount of the charge generating material means that the static elimination light is less likely to be absorbed by the charge generating material. Accordingly, the optical absorption coefficient of the photosensitive layer 502 can be readily adjusted to the specified range. As a result of the optical absorption coefficient being within the specified range, the static elimination light can reach the deep region of the photosensitive layer 502 and occurrence of a ghost image can be inhibited. The mass of the photosensitive layer 502 is a total mass of materials contained in the photosensitive layer 502. In the case of the photosensitive layer 502 containing a charge generating material, a hole transport material, an electron transport material, and a binder resin, the mass of the photosensitive layer 502 is a sum of mass of the charge generating material, mass of the hole transport material, mass of the electron transport material, and mass of the binder resin.

No particular limitations are placed on the charge generating material. Examples of charge generating materials that can be used include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The photosensitive layer 502 may contain only one charge generating material or may contain two or more charge generating materials.

Examples of phthalocyanine-based pigments that can be used include metal-free phthalocyanine, titanyl phthalocyanine, and chloroindium phthalocyanine. The titanyl phthalocyanine is represented by chemical formula (CGM-1). The metal-free phthalocyanine is represented by chemical formula (CGM-2).

(CGM-1)

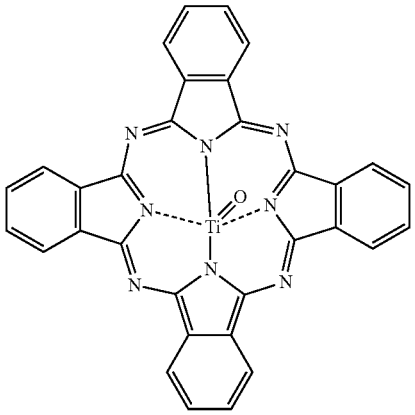

(CGM-2)

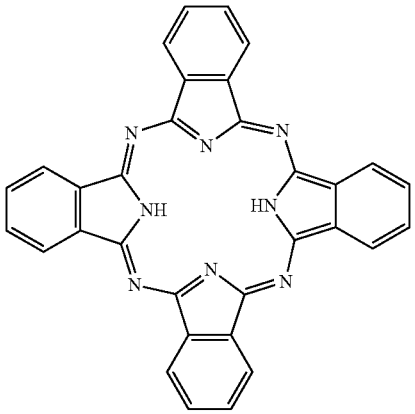

The titanyl phthalocyanine may have a crystal structure. Examples of titanyl phthalocyanine having a crystal structure include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively).

The charge generating material is preferably titanyl phthalocyanine, and more preferably Y-form titanyl phthalocyanine. As a result of the photosensitive layer 502 containing titanyl phthalocyanine (preferably, Y-form titanyl phthalocyanine), the optical absorption coefficient can be readily adjusted to the specified range. Setting the amount of the charge generating material contained in the photosensitive layer 502 to a relatively low range may reduce sensitivity of the photosensitive member 50 to the irradiation light. However, as long as the photosensitive layer 502 contains titanyl phthalocyanine (preferably, Y-form titanyl phthalocyanine) as the charge generating material, sensitivity of the photosensitive member 50 to the irradiation light can be maintained even if the amount of the charge generating material is low. The photosensitive layer 502 containing titanyl phthalocyanine may contain no other charge generating material or may contain another charge generating material in addition to the titanyl phthalocyanine.

Y-form titanyl phthalocyanine for example exhibits a main peak at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ+0.2°) from 3° to 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning rate is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of from 50° C. to 270° C. in a differential scanning calorimetry spectrum thereof, other than a peak resulting from vaporization of adsorbed water.

(B) Y-form titanyl phthalocyanine that does not exhibit a peak in a range of from 50° C. to 400° C. in a differential scanning calorimetry spectrum thereof, other than a peak resulting from vaporization of adsorbed water.

(C) Y-form titanyl phthalocyanine that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water.

Y-form titanyl phthalocyanine is preferable that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water. As a result of the photosensitive layer 502 containing Y-form titanyl phthalocyanine that exhibits such a DSC peak, the optical absorption coefficient can be readily adjusted to the specified range. As already mentioned, setting the amount of the charge generating material contained in the photosensitive layer 502 to a relatively low range may reduce sensitivity of the photosensitive member 50 to the irradiation light. However, as long as the photosensitive layer 502 contains, as the charge generating material, Y-form titanyl phthalocyanine that exhibits such a DSC peak as described above, sensitivity of the photosensitive member 50 to the irradiation light can be maintained even if the amount of the charge generating material is low. The Y-form titanyl phthalocyanine that exhibits such a DSC peak is preferably Y-form titanyl phthalocyanine that exhibits a single peak in a range of higher than 270° C. and no higher than 400° C., and more preferably Y-form titanyl phthalocyanine that exhibits a single peak at 296° C.

The following describes an example of a method for measuring a differential scanning calorimetry spectrum. A sample (titanyl phthalocyanine) is loaded into a sample pan, and a differential scanning calorimetry spectrum is measured using a differential scanning calorimeter (for example, "TAS-200 DSC8230D", product of Rigaku Corporation). The measurement range is for example from 40° C. to 400° C. The heating rate is for example 20° C./minute.

(Hole Transport Material)

No particular limitations are placed on the hole transport material. Examples of hole transport materials that can be used include nitrogen-containing cyclic compounds and condensed polycyclic compounds. Examples of nitrogen-containing cyclic compounds and condensed polycyclic compounds that can be used include triphenylamine derivatives, diamine derivatives (specific examples include N,N,N',N'-tetraphenylbenzidine derivatives. N,N,N',N'-tetraphenylphenylenediamine derivatives, N,N,N',N'-tetraphenylnaphtylenediamine derivatives, di(aminophenylethenyl) benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer 502 may contain only one hole transport material or may contain two or more hole transport materials.

Examples of hole transport materials that are preferable in terms of inhibiting occurrence of a ghost image include a compound represented by general formula (10) (also referred to below as a hole transport material (10)).

(10)

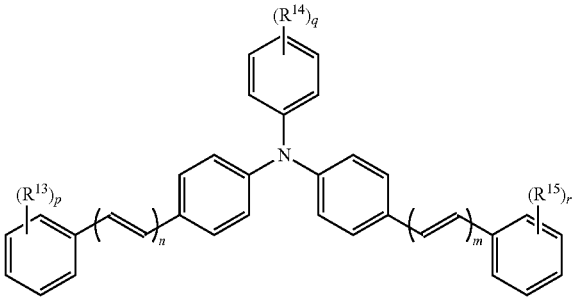

In general formula (10), $R^{13}$ to $R^{15}$ each represent, independently of one another, an alkyl group having a carbon number of at least 1 and no greater than 4 or an alkoxy group having a carbon number of at least 1 and no greater than 4. m and n each represent, independently of one another, an integer of at least 1 and no greater than 3. p and r each represent, independently of one another, 0 or 1. q represents an integer of at least 0 and no greater than 2. When q represents 2, two chemical groups $R^{14}$ may be the same as or different from one another.

In general formula (10), $R^{14}$ preferably represents an alkyl group having a carbon number of at least 1 and no greater than 4, more preferably a methyl group, an ethyl group, or an n-butyl group, and particularly preferably an n-butyl group. Preferably, q represents 1 or 2. More preferably, q represents 1. Preferably, p and r each represent 0. Preferably, m and n each represent 1 or 2. More preferably, m and n each represent 2.

Examples of preferable hole transport materials (10) include a compound represented by chemical formula (HTM-1) (also referred to below as a hole transport material (HTM-1)).

(HTM-1)

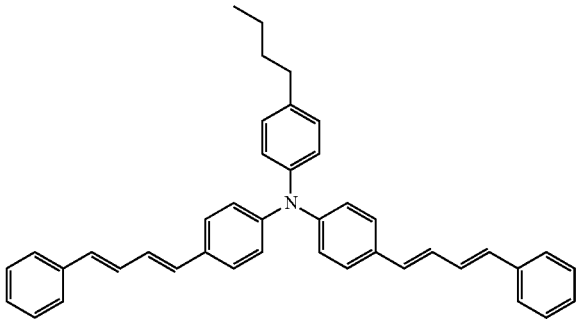

The hole transport material is preferably contained in an amount of greater than 0.0% by mass and no greater than 35.0% by mass relative to the mass of the photosensitive layer 502, and more preferably in an amount of at least 10.0% by mass and no greater than 30.0% by mass.

(Binder Resin)

Examples of binder resins that can be used include thermoplastic resins, thermosetting resins, and photocurable resins. Examples of thermoplastic resins that can be used include polycarbonate resins, polyarylate resins, styrene-butadiene copolymers, styrene-acrylonitrile copolymers, styrene-maleate copolymers, acrylic acid polymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include acrylic acid adducts of epoxy compounds and acrylic acid adducts of urethane compounds. The photosensitive layer 502 may contain only one binder resin or may contain two or more binder resins.

In order to inhibit occurrence of a ghost image, preferably, the binder resin includes a polyarylate resin including a repeating unit represented by general formula (20) (also referred to below as a polyarylate resin (20)).

(20)

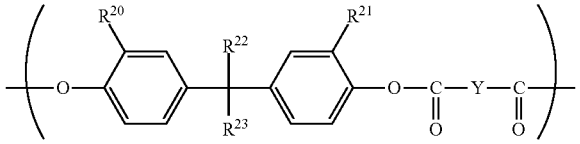

In general formula (20), $R^{20}$ and $R^{21}$ each represent, independently of one another, a hydrogen atom or an alkyl group having a carbon number of at least 1 and no greater than 4. $R^{22}$ and $R^{23}$ each represent, independently of one another, a hydrogen atom, a phenyl group, or an alkyl group having a carbon number of at least 1 and no greater than 4. $R^{22}$ and $R^{23}$ may be bonded to one another to form a divalent group represented by general formula (W). Y represents a divalent group represented by chemical formula (Y1), (Y2), (Y3), (Y4), (Y5), or (Y6).

(W)

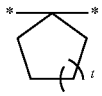

In general formula (W), t represents an integer of at least 1 and no greater than 3. Asterisks each represent a bond. Specifically, the asterisks in general formula (W) each represent a bond to a carbon atom bonded to Y in general formula (20).

(Y1)

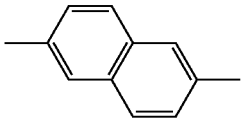

(Y2)

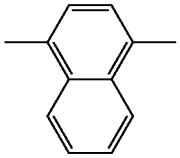

(Y3)

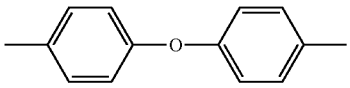

(Y4)

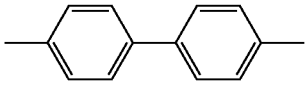

(Y5)

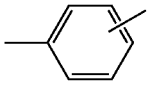

-continued (Y6)

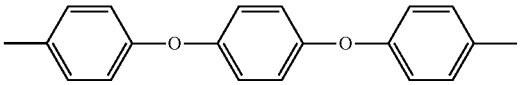

In general formula (20), $R^{20}$ and $R^{21}$ are each preferably an alkyl group having a carbon number of at least 1 and no greater than 4, and more preferably a methyl group. $R^{22}$ and $R^{23}$ are preferably bonded to one another to form a divalent group represented by general formula (W). Preferably, Y is a divalent group represented by chemical formula (Y1) or (Y3). In general formula (W), t is preferably 2.

Preferably, the polyarylate resin (20) only includes the repeating unit represented by general formula (20). However, the polyarylate resin (20) may further include another repeating unit. A ratio (mole fraction) of the number of the repeating units represented by general formula (20) to the total number of repeating units in the polyarylate resin (20) is preferably at least 0.80, more preferably at least 0.90, and still more preferably 1.00. The polyarylate resin (20) may only include one repeating unit represented by general formula (20) or may include a plurality of (for example, two) repeating units each represented by general formula (20).

Note that in the present specification, the ratio (mole fraction) of the number of the repeating units represented by general formula (20) to the total number of repeating units in the polyarylate resin (20) is not a value obtained from one resin chain but a number average obtained from all molecules of the polyarylate resin (20) (a plurality of resin chains) contained in the photosensitive layer 502. The mole fraction can for example be calculated from a $^{1}$H-NMR spectrum of the polyarylate resin (20) measured using a proton nuclear magnetic resonance spectrometer.

Examples of preferable repeating units represented by general formula (20) include repeating units represented by chemical formula (20-a) and chemical formula (20-b) (also referred to below as repeating units (20-a) and (20-b), respectively). The polyarylate resin (20) preferably includes at least one of the repeating units (20-a) and (20-b), and more preferably includes both of the repeating units (20-a) and (20-b).

(20-a)

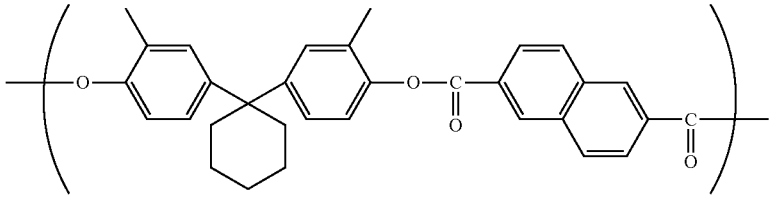

(20-b)

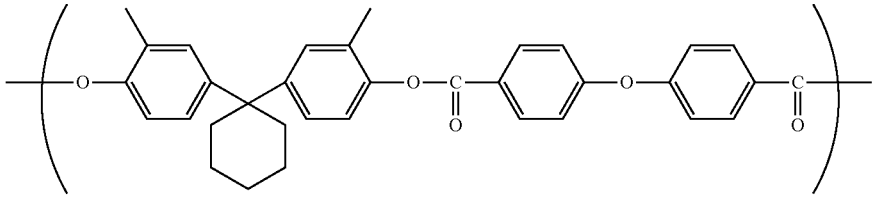

In the case of the polyarylate resin (20) including both of the repeating units (20-a) and (20-b), no particular limitations are placed on the sequence of the repeating units (20-a) and (20-b). The polyarylate resin (20) including the repeating units (20-a) and (20-b) may be any of a random copolymer, a block copolymer, a periodic copolymer, or an alternating copolymer.

Examples of preferable polyarylate resins (20) including both of the repeating units (20-a) and (20-b) include a polyarylate resin having a main chain represented by general formula (20-1).

(20-1)

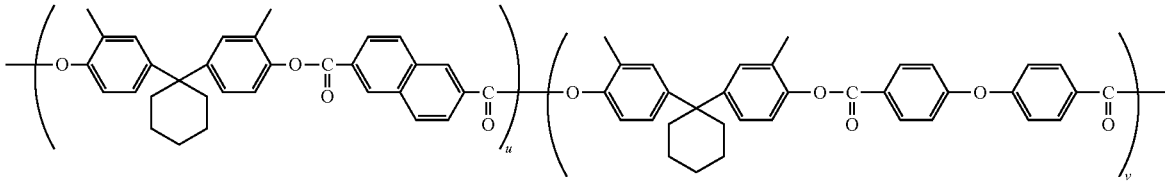

In general formula (20-1), a sum of u and v is 100. u is a number greater than or equal to 30 and less than or equal to 70.

Preferably, u is a number greater than or equal to 40 and less than or equal to 60, more preferably a number greater than or equal to 45 and less than or equal to 55, still more preferably a number greater than or equal to 49 and less than or equal to 51, and particularly preferably 50. Note that u represents a percentage of the number of the repeating units (20-a) relative to a sum of the number of the repeating units (20-a) and the number of the repeating units (20-b) in the polyarylate resin (20). v represents a percentage of the number of the repeating units (20-b) relative to the sum of the number of the repeating units (20-a) and the number of the repeating units (20-b) in the polyarylate resin (20). Examples of preferable polyarylate resins having a main chain represented by general formula (20-1) include a polyarylate resin having a main chain represented by general formula (20-1a).

(20-1a)

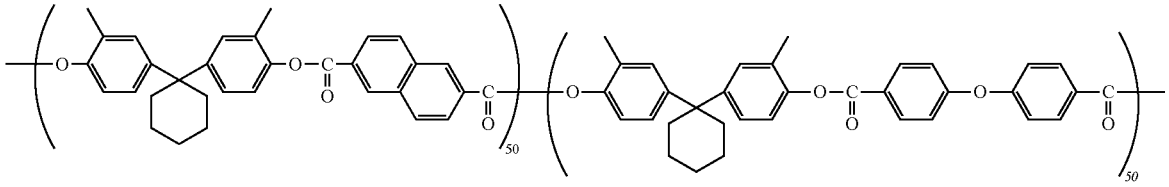

The polyarylate resin (20) may have a terminal group represented by chemical formula (Z). An asterisk in chemical formula (Z) represents a bond. Specifically, the asterisk in chemical formula (Z) represents a bond to the main chain of the polyarylate resin. In the case of the polyarylate resin (20) including the repeating unit (20-a), the repeating unit (20-b), and the terminal group represented by chemical formula (Z), the terminal group may be bonded to the repeating unit (20-a) or may be bonded to the repeating unit (20-b).

(Z)

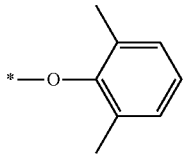

In order to inhibit occurrence of a ghost image, preferably, the polyarylate resin (20) includes a polyarylate resin having a main chain represented by general formula (20-1) and a terminal group represented by chemical formula (Z). More preferably, the polyarylate resin (20) includes a polyarylate resin having a main chain represented by general formula (20-1a) and a terminal group represented by chemical formula (Z). The polyarylate resin having a main chain represented by general formula (20-1a) and a terminal group represented by chemical formula (Z) is also referred to below as a polyarylate resin (R-1).

The binder resin preferably has a viscosity average molecular weight of at least 10,000, more preferably at least 20,000, still more preferably at least 30,000, further preferably at least 50,000, and particularly preferably at least 55.000. As a result of the viscosity average molecular weight of the binder resin being at least 10,000, the photosensitive member 50 tends to have improved abrasion resistance. The viscosity average molecular weight of the binder resin is preferably no greater than 80,000, and more preferably no greater than 70,000. As a result of the viscosity average molecular weight of the binder resin being no greater than 80,000, the binder resin tends to readily dissolve in a solvent for photosensitive layer formation, facilitating formation of the photosensitive layer 502.

The binder resin is preferably contained in an amount of at least 30.0% by mass and no greater than 70.0% by mass relative to the mass of the photosensitive layer 502, and more preferably in an amount of at least 40.0% by mass and no greater than 60.0% by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer 502 may contain only one electron transport material or may contain two or more electron transport materials.

Examples of electron transport materials that are preferable in terms of inhibiting occurrence of a ghost image include compounds represented by general formula (31), general formula (32), and general formula (33) (also referred to below as electron transport materials (31), (32), and (33), respectively).

(31)

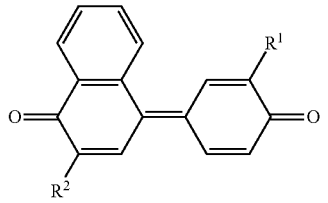

(32)

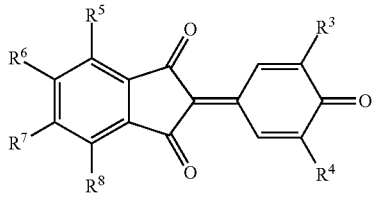

(33)

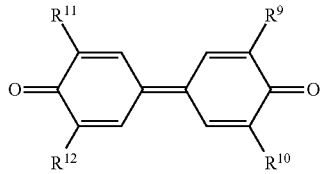

In general formulae (31) to (33), $R^1$ to $R^4$ and $R^9$ to $R^{12}$ each represent, independently of one another, an alkyl group having a carbon number of at least 1 and no greater than 8. $R^5$ to $R^8$ each represent, independently of one another, a hydrogen atom, a halogen atom, or an alkyl group having a carbon number of at least 1 and no greater than 4.

In general formulae (31) to (33), the alkyl group having a carbon number of at least 1 and no greater than 8 that may be represented by $R^1$ to $R^4$ and $R^9$ to $R^{12}$ is preferably an alkyl group having a carbon number of at least 1 and no greater than 5, and more preferably a methyl group, a tert-butyl group, or a 1,1-dimethylpropyl group. Preferably, $R^5$ to $R^8$ are each a hydrogen atom.

Preferably, the electron transport material (31) is a compound represented by chemical formula (ETM-1) (also referred to below as an electron transport material (ETM-1)). Preferably, the electron transport material (32) is a compound represented by chemical formula (ETM-3) (also referred to below as an electron transport material (ETM-3)). Preferably, the electron transport material (33) is a compound represented by chemical formula (ETM-2) (also referred to below as an electron transport material (ETM-2)).

(ETM-1)

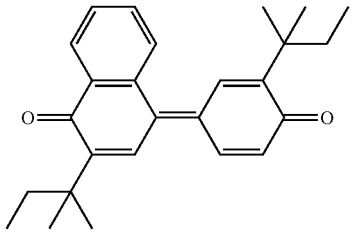

(ETM-2)

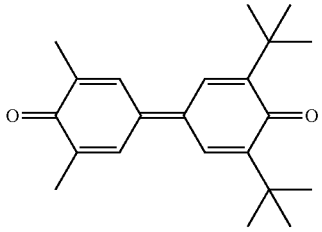

(ETM-3)

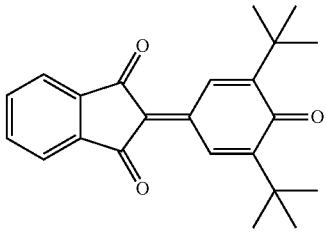

The photosensitive layer 502 of the photosensitive member 50 has a relatively low optical absorption coefficient, and thus the static elimination light reaches the deep region of the photosensitive layer 502. In a situation in which the wavelength of the irradiation light is equal to or close to the wavelength of the static elimination light, the irradiation light also reaches the deep region of the photosensitive layer 502. Upon light irradiation for image formation, holes and electrons are generated from the charge generating material in the deep region of the photosensitive layer 502. That is, a distance by which the electron transport material transports the electrons to the surface of the photosensitive layer 502 is long. In order to increase the electron transport velocity, the photosensitive layer 502 preferably contains at least one of the electron transport materials (31) and (32), and more preferably contains both (two) of the electron transport materials (31) and (32) as the electron transport material. In order to increase the electron transport velocity, the photosensitive layer 502 preferably contains at least one of the electron transport materials (ETM-1) and (ETM-3), and more preferably contains both (two) of the electron transport materials (ETM-1) and (ETM-3) as the electron transport material.

The electron transport material is preferably contained in an amount of at least 5.0% by mass and no greater than 50.0% by mass relative to the mass of the photosensitive layer 502, and more preferably in an amount of at least 20.0% by mass and no greater than 30.0% by mass. In the case of the photosensitive layer 502 containing two or more electron transport materials, the amount of the electron transport material refers to a total amount of the two or more electron transport materials.

The photosensitive layer 502 may further contain an additive as necessary. Examples of additives that can be used include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. In a situation in which the use of an additive is necessary, the photosensitive layer 502 may contain only one additive or may contain two or more additives.

(Combination of Materials)

In terms of readily adjusting the optical absorption coefficient to the specified range and inhibiting occurrence of a ghost image, the following combinations of materials of the photosensitive layer 502 are preferable. Preferably, the charge generating material is Y-form titanyl phthalocyanine and is contained in a specified amount, and the electron transport material is the electron transport material (ETM-1) and the electron transport material (ETM-3). Preferably, the charge generating material is Y-form titanyl phthalocyanine and is contained in a specified amount, the electron transport material is the electron transport material (ETM-1) and the electron transport material (ETM-3), and the binder resin is a polyarylate resin having a main chain represented by general formula (20-1) and a terminal group represented by chemical formula (Z). More preferably, the charge generating material is Y-form titanyl phthalocyanine and is contained in a specified amount, the electron transport material is the electron transport material (ETM-1) and the electron transport material (ETM-3), and the binder resin is the polyarylate resin (R-1). Preferably, the charge generating material is Y-form titanyl phthalocyanine and is contained in a specified amount, the electron transport material is the electron transport material (ETM-1) and the electron transport material (ETM-3), the binder resin is a polyarylate resin having a main chain represented by general formula (20-1) and a terminal group represented by chemical formula (Z), and the hole transport material is the hole transport material (HTM-1). More preferably, the charge generating material is Y-form titanyl phthalocyanine and is contained in a specified amount, the electron transport material is the electron transport material (ETM-1) and the electron transport material (ETM-3), the binder resin is the polyarylate resin (R-1), and the hole transport material is the hole transport material (HTM-1). The specified amount in these preferable combinations of materials refers to any of the preferable examples of the amount of the charge generating material mentioned above. Preferably, the Y-form titanyl phthalocyanine in these preferable examples of materials does not exhibit a peak in a range of from 50° C. to 270° C. and exhibits a peak in a range of higher than 270° C. and no higher than 400° C. (specifically, a single peak at 296° C.) in a differential scanning calorimetry spectrum thereof, other than a peak resulting from vaporization of adsorbed water.

(Intermediate Layer)

The intermediate layer 503 for example contains inorganic particles and a resin for use in the intermediate layer 503 (intermediate layer resin). Provision of the intermediate layer 503 can facilitate flow of current generated when the photosensitive member 50 is irradiated with light and inhibit increasing resistance, while also maintaining insulation to a sufficient degree so as to inhibit occurrence of leakage current.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. The inorganic particles may be surface-treated. No particular limitations are placed on the intermediate layer resin other than being a resin that can be used for forming the intermediate layer 503.

(Production Method of Photosensitive Member)

According to an example of the production method of the photosensitive member 50, an application liquid for formation of the photosensitive layer 502 (also referred to below as an application liquid for photosensitive layer formation) is applied onto the conductive substrate 501 and dried. Through the above, the photosensitive layer 502 is formed, producing the photosensitive member 50. The application liquid for photosensitive layer formation is prepared by dissolving or dispersing a charge generating material, a hole transport material, an electron transport material, a binder resin, and an optional component as necessary in a solvent.

No particular limitations are placed on the solvent contained in the application liquid for photosensitive layer formation other than that the components of the application liquid should be soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member 50, a non-halogenated solvent (a solvent other than a halogenated hydrocarbon) is preferably used.

The application liquid for photosensitive layer formation is prepared by dispersing the components in the solvent by mixing. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied other than being a method that enables uniform application of the application liquid for photosensitive layer formation on the conductive substrate 501. Examples of application methods that can be used include blade coating, dip coating, spray coating, spin coating, and bar coating.

No particular limitations are placed on the method by which the application liquid for photosensitive layer formation is dried other than being a method that enables evaporation of the solvent in the application liquid for photosensitive layer formation. An example of a method involves heat treatment (hot-air drying) using a high-temperature dryer or a reduced pressure dryer. The heat treatment temperature is for example from 40° C. to 150° C. The heat treatment time is for example from 3 minutes to 120 minutes.

Note that the production method of the photosensitive member 50 may further include either or both of a process of forming the intermediate layer 503 and a process of forming the protective layer 504 as necessary. The process of forming the intermediate layer 503 and the process of forming the protective layer 504 are each performed according to a method appropriately selected from known methods.

<Static Elimination Lamp>

Referring again to FIG. 2, the following describes the static elimination lamp 54. The static elimination lamp 54 emits static elimination light having a wavelength of at least 600 nm and no greater than 800 nm. Combining the static elimination light having a wavelength in the above-specified range with the photosensitive layer 502 having an optical absorption coefficient within the specified range enables the static elimination light to reach the deep region of the photosensitive layer 502. Thus, the image forming apparatus 1 can inhibit occurrence of a ghost image.

Preferably, an intensity of the static elimination light upon arrival at the circumferential surface 50*a* of the photosensitive member 50 after having been emitted from the static elimination lamp 54 (referred to below as a static elimination light intensity) is at least 1 $\mu J/cm^2$ and no greater than 5 $\mu J/cm^2$. As a result of the static elimination light intensity being within the above-specified range, the static elimination light can reach the deep region of the photosensitive layer 502, and occurrence of a ghost image can be inhibited. The static elimination light intensity of the static elimination lamp 54 can be measured according to a method described in association with Examples.

The static elimination lamp 54 is located downstream of the primary transfer roller 53 in the rotation direction R of the photosensitive member 50. The cleaner 55 is located downstream of the static elimination lamp 54 in the rotation direction R of the photosensitive member 50. The charging roller 51 is located downstream of the cleaner 55 in the rotation direction R of the photosensitive member 50. Since the static elimination lamp 54 is located between the primary transfer roller 53 and the cleaner 55, it is ensured that a time from static elimination of the circumferential surface 50*a* of the photosensitive member 50 by the static elimination lamp 54 to charging of the circumferential surface 50*a* of the photosensitive member 50 by the charging roller 51 (also referred to below as a static elimination-charging time) is sufficiently long. Thus, a time for eliminating excited carriers generated within the photosensitive layer 502 is ensured, and occurrence of a ghost image is inhibited. In order to inhibit occurrence of a ghost image, the static elimination-charging time is preferably at least 20 milliseconds, and more preferably at least 50 milliseconds. In order to perform high-speed printing, the static elimination-charging time is preferably no greater than 400 milliseconds, more preferably no greater than 300 milliseconds, and still more preferably no greater than 150 milliseconds.

The following describes the charging rollers 51, the primary transfer rollers 53, the cleaners 55, and a thrust mechanism of the photosensitive members 50 included in the image forming apparatus 1.

<Charging Roller>

Each charging roller 51 is located in contact with or adjacent to the circumferential surface 50*a* of the corresponding photosensitive member 50. The image forming apparatus 1 adopts a direct discharge process or a proximity discharge process. The charging time is shorter and the charge amount to the photosensitive member 50 is smaller in a configuration including the charging roller 51 located in contact with or adjacent to the circumferential surface 50*a* of the photosensitive member 50 than in a configuration including a scorotron charger. In image formation using the image forming apparatus 1 including the charging roller 51 located in contact with or adjacent to the circumferential surface 50*a* of the photosensitive member 50, therefore, it is difficult to uniformly charge the circumferential surface 50*a* of the photosensitive member 50 and a ghost image can easily occur. However, as already described, the image forming apparatus 1 according to the present embodiment includes the photosensitive members 50 that are capable of inhibiting occurrence of a ghost image. The image forming apparatus 1 can therefore sufficiently inhibit occurrence of a ghost image even if each charging roller 51 is located in contact with or adjacent to the circumferential surface 50*a* of the corresponding photosensitive member 50.

A distance between the charging roller 51 and the circumferential surface 50*a* of the photosensitive member 50 is preferably no greater than 50 μm, and more preferably no greater than 30 μm. The image forming apparatus 1 according to the present embodiment can sufficiently inhibit occurrence of a ghost image even if the distance between each charging roller 51 and the circumferential surface 50*a* of the corresponding photosensitive member 50 is in the above-specified range.

The charging voltage (charging bias) that is applied to the charging roller 51 is a direct current voltage. The amount of electrical discharge from the charging roller 51 to the photosensitive member 50 can be smaller and the abrasion amount of the photosensitive layer 502 of the photosensitive member 50 can be smaller in a configuration in which the charging voltage is a direct current voltage than in a configuration in which the charging voltage is a composite voltage of an alternating current voltage superimposed on a direct current voltage.

A ghost image tends to occur particularly when the charging roller 51 is located in contact with or adjacent to the circumferential surface 50*a* of the photosensitive member 50 and the charging voltage is a direct current voltage. However, as long as the optical absorption coefficient of the photosensitive layer 502 of the photosensitive member 50 is within the specified range, the image forming apparatus 1 according to the present embodiment can sufficiently inhibit occurrence of a ghost image even if each charging roller 51 is located in contact with or adjacent to the circumferential surface 50*a* of the corresponding photosensitive member 50 and the charging voltage is a direct current voltage.

The charging roller 51 preferably has a resistance of at least 5.0 log Ω and no greater than 7.0 log Ω, and more preferably at least 5.0 log Ω and no greater than 6.0 log Ω. As a result of the resistance of the charging roller 51 being at least 5.0 log Ω, leakage current in the photosensitive layer 502 of the photosensitive member 50 tends not to occur. As a result of the resistance of the charging roller 51 being no greater than 7.0 log Ω, elevation of the resistance of the charging roller 51 tends not to occur.

<Primary Transfer Roller>

Figure 7:
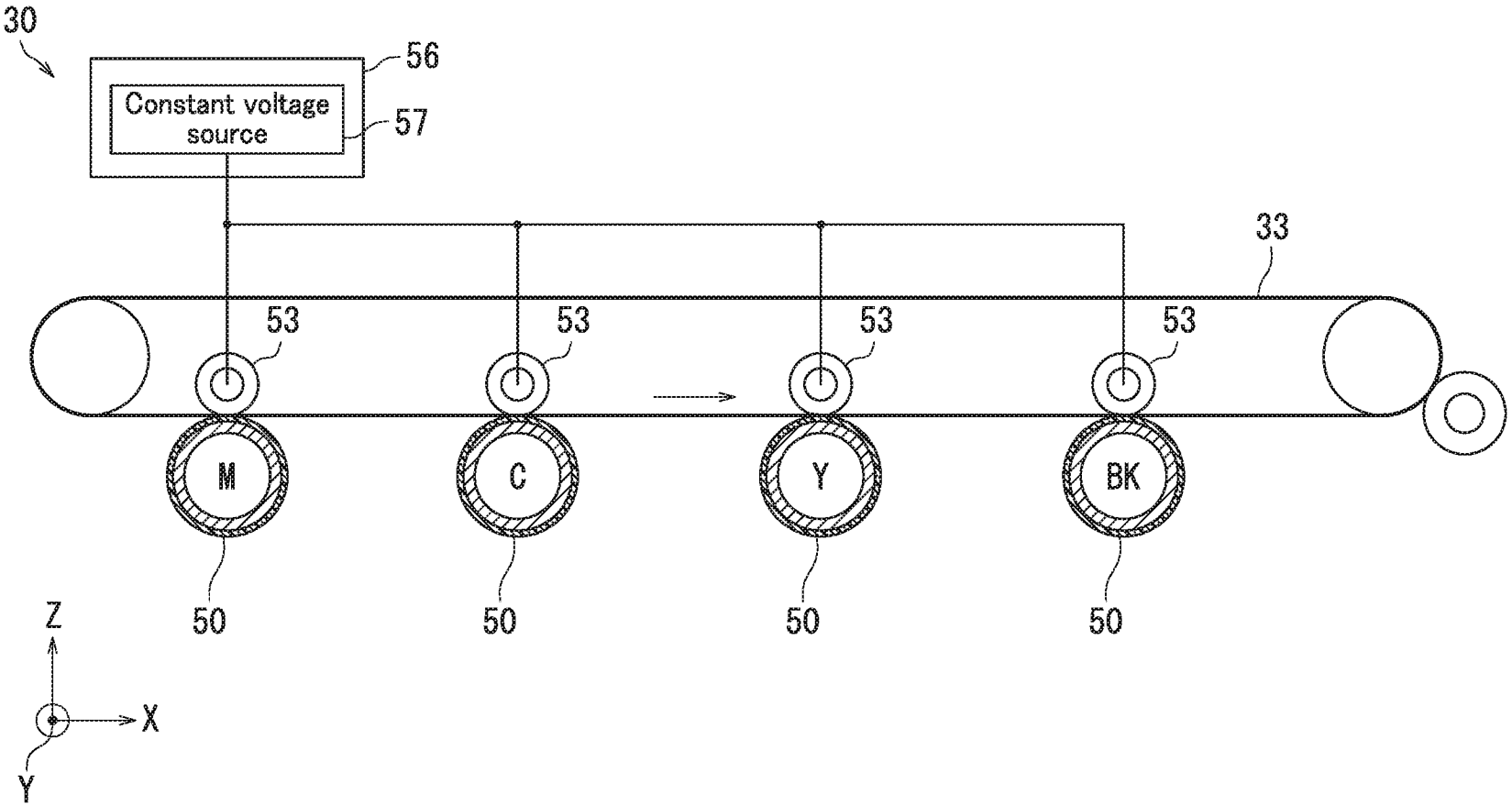
FIG. 7 is a diagram illustrating a power supply system for primary transfer rollers included in the image forming apparatus illustrated in FIG. 1.

The following describes the primary transfer rollers 53, which are under constant-voltage control, with reference to FIG. 7. FIG. 7 is a diagram illustrating a power supply system for the four primary transfer rollers 53. As illustrated in FIG. 7, the image forming section 30 further includes a power source 56 connected with the four primary transfer rollers 53. The power source 56 can charge each of the primary transfer rollers 53. The power source 56 includes a constant voltage source 57 connected with the four primary transfer rollers 53. The constant voltage source 57 applies a transfer voltage (a transfer bias) to the primary transfer rollers 53 to charge the primary transfer rollers 53 in primary transfer. The constant voltage source 57 generates a constant transfer bias (for example, a constant negative transfer bias). That is, the primary transfer rollers 53 are under constant-voltage control. A potential difference (transfer fields) between the surface potential of the circumferential surfaces 50*a* of the photosensitive members 50 and the surface potential of the primary transfer rollers 53 causes primary transfer of the toner images carried on the circumferential surfaces 50*a* of the respective photosensitive members 50 to the outer surface of the circulating transfer belt 33.

In primary transfer, a current (for example, a negative current) flows from the primary transfer rollers 53 into the respective photosensitive members 50 through the transfer belt 33. In a configuration in which the primary transfer rollers 53 are disposed right above the respective photosensitive members 50, the current flows from the primary transfer rollers 53 into the photosensitive members 50 in a thickness direction of the transfer belt 33. The current flowing into the photosensitive members 50 (flow-in current) changes as the volume resistivity of the transfer belt 33 changes provided that a constant transfer voltage is applied to the primary transfer rollers 53. The tendency of a ghost image to occur increases with an increase in the flow-in current. That is, a ghost image is more likely to occur in an image formed by the image forming apparatus 1 including the primary transfer rollers 53, which are under constant-voltage control, than in an image formed by an image forming apparatus that adopts constant-current control. However, the image forming apparatus 1 according to the present embodiment includes the photosensitive members 50 capable of inhibiting occurrence of a ghost image. It is therefore possible to inhibit occurrence of a ghost image even if an image is formed using the image forming apparatus 1 including the primary transfer rollers 53 under constant-voltage control. In the image forming apparatus 1 including the primary transfer rollers 53 under constant-voltage control, the number of constant voltage sources 57 can be smaller than the number of primary transfer rollers 53. Thus, the image forming apparatus 1 can be simplified and miniaturized.

In order to perform stable primary transfer of the toners T from the primary transfer rollers 53 to the transfer belt 33, the current (transfer current) flowing through the primary transfer rollers 53 during application of the transfer voltage is preferably at least −20 μA and no greater than −10 μA. In order to perform stable primary transfer of the toners T from the primary transfer rollers 53 to the transfer belt 33, preferably, the transfer charge density of the primary transfer rollers 53 upon application of the transfer voltage is at least $-1.4\times10^{-4}$ C/m$^2$.

<Cleaner>

Each of the cleaners 55 includes the cleaning blade 81 and a toner seal 82. The cleaning blade 81 is equivalent to what may be referred to as a cleaning member. The cleaning blade 81 is located downstream of the corresponding primary transfer roller 53 in the rotation direction R of the corresponding photosensitive member 50. The cleaning blade 81 is pressed against the circumferential surface 50*a* of the photosensitive member 50 and collects residual toner T on the circumferential surface 50*a* of the photosensitive member 50. The residual toner T refers to the toner T remaining on the circumferential surface 50*a* of the photosensitive member 50 after primary transfer. Specifically, a distal end of the cleaning blade 81 is pressed against the circumferential surface 50*a* of the photosensitive member 50, and a direction from a proximal end to the distal end of the cleaning blade 81 is opposite to the rotation direction R at a point of contact between the distal end of the cleaning blade 81 and the circumferential surface 50*a* of the photosensitive member 50. The cleaning blade 81 is in counter-contact with the circumferential surface 50*a* of the photosensitive member 50. Thus, the cleaning blade 81 is tightly pressed against the circumferential surface 50*a* of the photosensitive member 50 such that the cleaning blade 81 digs into the photosensitive member 50 as the photosensitive member 50 rotates. Insufficient cleaning can be further prevented through the cleaning blade 81 being tightly pressed against the circumferential surface 50*a* of the photosensitive member 50. The cleaning blade 81 is for example a plate-shaped elastic member. More specifically, the cleaning blade 81 is plate-shaped rubber. The cleaning blade 81 is in line-contact with the circumferential surface 50*a* of the photosensitive member 50.

Preferably, the linear pressure of the cleaning blade 81 on the circumferential surface 50*a* of the photosensitive member 50 is at least 10 N/m and no greater than 40 N/m. As a result of the linear pressure of the cleaning blade 81 on the circumferential surface 50*a* of the photosensitive member 50 being at least 10 N/m, insufficient cleaning can be prevented. As a result of the linear pressure of the cleaning blade 81 on the circumferential surface 50*a* of the photosensitive member 50 being no greater than 40 N/m, occurrence of a ghost image can be inhibited.

The cleaning blade 81 preferably has a hardness of at least 60 and no greater than 80, and more preferably at least 70 and no greater than 78. As a result of the hardness of the cleaning blade 81 being at least 60, the cleaning blade 81 is not too soft, favorably preventing insufficient cleaning. As a result of the hardness of the cleaning blade 81 being no greater than 80, the cleaning blade 81 is not too hard, reducing the abrasion amount of the photosensitive layer 502 of the photosensitive member 50.

The cleaning blade 81 preferably has a rebound resilience of at least 20% and no greater than 40%, and more preferably at least 25% and no greater than 35%.

The toner seal 82 is located in contact with the circumferential surface 50*a* of the photosensitive member 50 between the corresponding primary transfer roller 53 and the cleaning blade 81, and prevents the toner T collected by the cleaning blade 81 from scattering.

<Thrust Mechanism>

Figure 8:
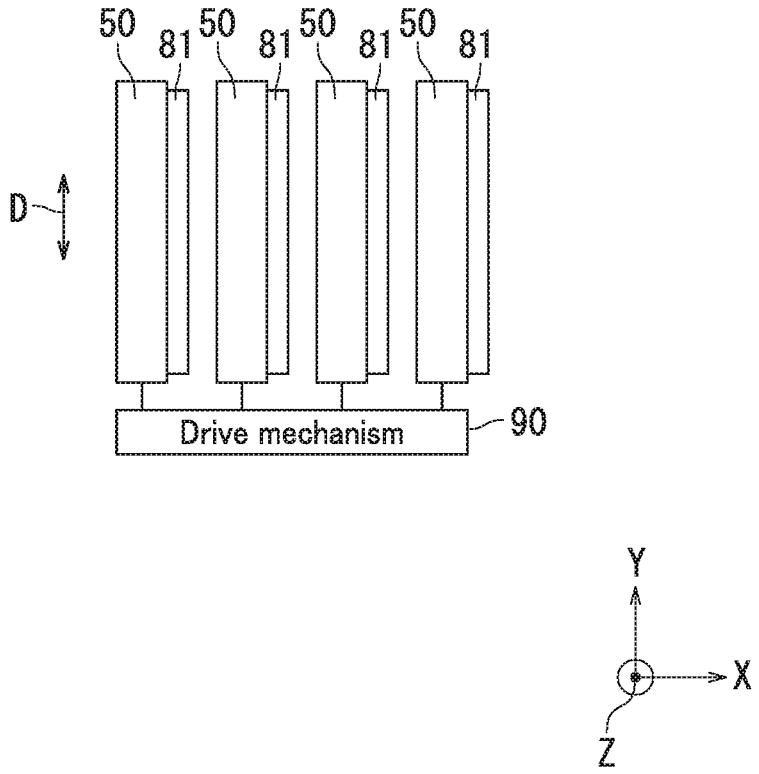
FIG. 8 is a diagram illustrating a drive mechanism for implementing a thrust mechanism.

The following describes a drive mechanism 90 for implementing a thrust mechanism with reference to FIG. 8. FIG. 8 is a plan view illustrating the photosensitive members 50, the cleaning blades 81, and the drive mechanism 90. Each of the photosensitive members 50 has a circular tubular shape elongated in a rotational axis direction D of the photosensitive member 50. Each of the cleaning blades 81 has a plate-like shape elongated in the rotational axis direction D.

The image forming apparatus 1 further includes the drive mechanism 90. The drive mechanism 90 causes either the photosensitive members 50 or the cleaning blades 81 to reciprocate in the rotational axis direction D. In the present embodiment, the drive mechanism 90 causes the photosensitive members 50 to reciprocate in the rotational axis direction D. The drive mechanism 90 for example includes a drive source such as a motor, a gear train, a plurality of cams, and a plurality of elastic members. The cleaning blades 81 are fixed to a housing of the image forming apparatus 1.

By causing the photosensitive members 50 to reciprocate in the rotational axis direction D against the cleaning blades 81, local accumulation on and around the edge of each cleaning blade 81 can be moved in the rotational axis direction D, preventing a scratch in a circumferential direction (referred to below as "a circumferential scratch") from occurring on the circumferential surface 50*a* of the corresponding photosensitive member 50. As a result, a streak that may occur in output images due to the toner T stuck in such a circumferential scratch is prevented. Thus, good quality of resulting images can be maintained over a long period of time.

Furthermore, according to the present embodiment in which the photosensitive members 50 are caused to reciprocate, it is easy to obtain driving force required for the reciprocation and restrict occurrence of toner leakage over opposite ends of each of the cleaning blades 81, compared to a configuration in which the cleaning blades 81 are caused to reciprocate.

The thrust amount of each photosensitive member 50 refers to a distance by which the photosensitive member 50 travels in one way of one back-and-forth motion. Note that in the present embodiment, an outward thrust amount and a return thrust amount are the same. The thrust amount of the photosensitive member 50 is preferably at least 0.1 mm and no greater than 2.0 mm, and more preferably at least 0.5 mm and no greater than 1.0 mm. As a result of the thrust amount of the photosensitive members 50 being within the above-specified range, occurrence of a circumferential scratch on the photosensitive member 50 can be favorably prevented.

The thrust period of each photosensitive member 50 refers to a time taken by the photosensitive member 50 to make one back-and-forth motion. In the present specification, the thrust period of the photosensitive member 50 is indicated by the number of rotations of the photosensitive member 50 per back-and-forth motion of the photosensitive member 50. The rotation speed of the photosensitive member 50 is constant. Accordingly, a longer thrust period of the photosensitive member 50 (i.e., more rotations of the photosensitive member 50 per back-and-forth motion of the photosensitive member 50) means that the photosensitive member 50 reciprocates more slowly. A shorter thrust period of the photosensitive member 50 (i.e., fewer rotations of the photosensitive member 50 per back-and-forth motion of the photosensitive member 50) means that the photosensitive member 50 reciprocates faster.

The thrust period of the photosensitive member 50 is preferably at least 10 rotations and no greater than 200 rotations, and more preferably at least 50 rotations and no greater than 100 rotations. As a result of the thrust period of the photosensitive member 50 being at least 10 rotations, it is easy to clean the circumferential surface 50*a* of the photosensitive member 50. Furthermore, as a result of the thrust period of the photosensitive member 50 being at least 10 rotations, the color image forming apparatus 1 tends not to undergo unintended coloristic shift. As a result of the thrust period of the photosensitive member 50 being no greater than 200 rotations, occurrence of a circumferential scratch on the photosensitive member 50 can be prevented.

Through the above, the image forming apparatus 1 according to the present embodiment has been described. Although a configuration has been described in which the charging rollers 51 are employed as chargers, the image forming apparatus 1 may have a configuration in which the chargers are charging brushes located in contact with or adjacent to the circumferential surfaces 50*a* of the respective photosensitive members 50. Although the chargers adopting a direct discharge process or a proximity discharge process (specifically, the charging rollers 51) have been described, the present disclosure is also applicable to chargers adopting a discharge process other than the direct discharge process and the proximity discharge process. Although a configuration in which the charging voltage is a direct current voltage has been described, the present disclosure is also applicable to a configuration in which the charging voltage is an alternating current voltage or a composite voltage. The composite voltage refers to a voltage of an alternating current voltage superimposed on a direct current voltage. Although the development rollers 52 each using a two-component developer containing the carrier CA and the toner T have been described, the present disclosure is also applicable to development devices each using a one-component developer. Although the image forming apparatus 1 adopting an intermediate transfer process has been described, the present disclosure is also applicable to an image forming apparatus adopting a direct transfer process. In the intermediate transfer process, the primary transfer rollers 53 perform primary transfer of toner images from the respective photosensitive members 50 to the transfer belt 33, and the secondary transfer roller 34 performs secondary transfer of the toner images from the transfer belt 33 to a sheet P. In the direct transfer process, the primary transfer rollers 53 transfer toner images from the respective photosensitive members 50 to a sheet P.

[Image Forming Method]

The following describes an image forming method that is implemented by the image forming apparatus 1 according to the present embodiment. This image forming method includes static elimination. In the static elimination, each static elimination lamp 54 irradiates the static elimination light onto the circumferential surface 50*a* of the corresponding photosensitive member 50. The photosensitive member 50 includes the conductive substrate 501 and the single-layer photosensitive layer 502. The photosensitive layer 502 contains a charge generating material, a hole transport material, an electron transport material, and a binder resin. The static elimination light irradiated by the static elimination lamp 54 has a wavelength of at least 600 nm and no greater than 800 nm. The optical absorption coefficient of the photosensitive layer 502 with respect to light having a wavelength of 660 nm is at least 600 $cm^{-1}$ and no greater than 1,500 $cm^{-1}$. The image forming method that is implemented by the image forming apparatus 1 according to the present embodiment can inhibit occurrence of a ghost image while ensuring toner transferring performance.

EXAMPLES

The following provides more specific description of the present disclosure through use of Examples. However, the present disclosure is not limited to the scope of Examples. Photosensitive members (A-1) to (A-6) according to Examples and photosensitive members (B-1) to (B-7) according to Comparative Examples to be mounted in an image forming apparatus were produced. Table 1 shows materials, compositions, and the optical absorption coefficient of the photosensitive layers of the photosensitive members (A-1) to (A-6) and (B-1) to (B-7).

TABLE 1

| Photosensitive member | Amount (wt %) CGM CGM-1 | CGM CGM-2 | HTM HTM-1 | ETM ETM-1 | ETM ETM-3 | Resin R-1 | Optical absorption coefficient [$cm^{-1}$] |
|---|---|---|---|---|---|---|---|
| A-1 | 0.7 | — | 21.6 | 11.7 | 11.7 | 54.3 | 600 |
| A-2 | 0.8 | — | 21.6 | 11.7 | 11.7 | 54.2 | 700 |
| A-3 | 0.9 | — | 21.6 | 11.7 | 11.7 | 54.1 | 770 |
| A-4 | 1.0 | — | 21.6 | 11.7 | 11.7 | 54.0 | 870 |
| A-5 | 1.2 | — | 21.6 | 11.7 | 11.7 | 53.8 | 1000 |
| A-6 | 1.8 | — | 21.6 | 11.7 | 11.7 | 53.2 | 1,500 |
| B-1 | 2.3 | — | 21.6 | 11.7 | 11.7 | 52.7 | 2000 |
| B-2 | 2.8 | — | 21.6 | 11.7 | 11.7 | 52.2 | 2500 |
| B-3 | 3.6 | — | 21.6 | 11.7 | 11.7 | 51.4 | 3000 |
| B-4 | 3.9 | — | 21.6 | 11.7 | 11.7 | 51.1 | 3500 |
| B-5 | — | 1.6 | 21.6 | 11.7 | 11.7 | 53.4 | 4000 |
| B-6 | — | 1.9 | 21.6 | 11.7 | 11.7 | 53.1 | 4500 |
| B-7 | — | 2.1 | 21.6 | 11.7 | 11.7 | 52.9 | 5000 |

In Table 1, "CGM", "HTM". "ETM", and "Resin" respectively mean "charge generating material", "hole transport material", "electron transport material", and "binder resin". In Table 1, "-" means that the material is not contained in the photosensitive layer. In Table 1, "Amount" means a percentage of the mass of the material (unit: wt %, which is % by mass) relative to the mass of the photosensitive layer. The mass of the photosensitive layer is equivalent to the total mass of solids (more specifically, the charge generating material, the hole transport material, the electron transport materials, and the binder resin) contained in the application liquid for photosensitive layer formation.

In Table 1, "CGM-1" means the Y-form titanyl phthalocyanine represented by chemical formula (CGM-1) described in association with the embodiment. This Y-form titanyl phthalocyanine did not exhibit a peak in a range of from 50° C. to 270° C. and exhibited a peak in a range of higher than 270° C. and no higher than 400° C. (specifically, a single peak at 296° C.) in a differential scanning calorimetry spectrum thereof, other than a peak resulting from vaporization of adsorbed water.

In Table 1, "CGM-2" means the X-form metal-free phthalocyanine represented by chemical formula (CGM-2) described in association with the embodiment. In Table 1, "HTM-1" means the hole transport material (HTM-1) described in association with the embodiment. In Table 1, "ETM-1" and "ETM-3" respectively mean the electron transport material (ETM-1) and the electron transport material (ETM-3) described in association with the embodiment.

In Table 1, "R-1" means the polyarylate resin (R-1) described in association with the embodiment. The polyarylate resin (R-1) had a viscosity average molecular weight of 60,000.

The following describes production methods of the photosensitive members shown in Table 1 and a measurement method of the optical absorption coefficient.

<Production Method of Photosensitive Member>

(Production of Photosensitive Member (A-1))

A vessel of a ball mill was charged with 0.7 part by mass of the Y-form titanyl phthalocyanine as the charge generating material, 21.6 parts by mass of the hole transport material (HTM-1), 11.7 parts by mass of the electron transport material (ETM-1), 11.7 parts by mass of the electron transport material (ETM-3), 54.3 parts by mass of the polyarylate resin (R-1) as the binder resin, and tetrahydrofuran as a solvent. The vessel contents were mixed for 50 hours using the ball mill to give an application liquid for photosensitive layer formation. The application liquid for photosensitive layer formation was applied onto a conductive substrate (specifically, an aluminum drum-shaped support) by dip coating to form a liquid film. The liquid film was hot-air dried at 100° C. for 40 minutes. Through the above, a single-layer photosensitive layer (film thickness: 30 μm) was formed on the conductive substrate. As a result, a photosensitive member (A-1) was obtained.

(Production of Photosensitive Members (A-2) to (A-6) and (B-1) to (B-7))

Each of photosensitive members (A-2) to (A-6) and (B-1) to (B-7) was produced according to the same method as in the production of the photosensitive member (A-1) in all aspects other than that the charge generating material of type specified in Table 1 was used, and the charge generating material and the polyarylate resin (R-1) were each added in an amount to give the amount specified in Table 1.

<Measurement Method of Optical Absorption Coefficient>

The optical absorption coefficient of the photosensitive layer of each of the photosensitive members (A-1) to (A-6) and (B-1) to (B-7) was measured according to the following method. The application liquid for photosensitive layer formation prepared as described in the section <Production Method of Photosensitive Member> above was applied onto an overhead projector sheet (OHP sheet) to form a liquid film. A wire bar was used to adjust the thickness of the liquid film so as to give a photosensitive layer having a thickness of 30 μm after hot-air drying. The liquid film was hot-air dried at 100° C. for 40 minutes. Through the above, a single-layer photosensitive layer (film thickness: 30 μm) was formed on the OHP sheet. Thus, an evaluation sample including the OHP sheet and the photosensitive layer on the OHP sheet was prepared. The film thickness of the photosensitive layer was measured using an eddy-current coating thickness tester ("LH-373", product of Kett Electric Laboratory).

An absorbance A of the evaluation sample with respect to light having a wavelength of 660 nm was measured using a spectrophotometer ("U-3000", product of Hitachi. Ltd.). Note that the absorbance of an OHP sheet having no photosensitive layer with respect to light having a wavelength of 660 nm was measured beforehand. The absorbance of the OHP sheet having no photosensitive layer was used as a baseline to correct the absorbance A of the evaluation sample. Based on the corrected absorbance A, the amount (concentration) c of the charge generating material relative to the mass of the photosensitive layer, and the thickness (optical path length) L of the photosensitive layer, an optical absorption coefficient $\alpha_2$ of the evaluation sample was calculated in accordance with formula (2).

$$A=\alpha_2 \times L \times c \quad (2)$$

The thus calculated optical absorption coefficient $\alpha_2$ was as shown in Table 1. As shown in Table 1, each of the photosensitive members (A-1) to (A-6) included a photosensitive layer having an optical absorption coefficient within the specified range (i.e., at least 600 $cm^{-1}$ and no greater than 1,500 $cm^{-1}$). By contrast, each of the photosensitive members (B-1) to (B-7) included a photosensitive layer having an optical absorption coefficient of greater than 1,500 $cm^{1}$.

<Evaluation Method of Transfer Charge Density>

With respect to each of the photosensitive members (A-1) to (A-6) and (B-1) to (B-7), the photosensitive member was mounted in an evaluation apparatus, and the transfer charge density thereof was evaluated.

(Evaluation Apparatus)

The evaluation apparatus was a modified version of a multifunction peripheral ("TASKALFA 356Ci", product of KYOCERA Document Solutions Inc.). A configuration and settings of the evaluation apparatus were as follows.

Diameter of photosensitive member: 30 mm
Linear velocity of photosensitive member: 100 mm/second, 200 mm/second, or 300 mm/second
Thrust amount of photosensitive member: 0.8 mm
Thrust period of photosensitive member: 70 rotations/back-and-forth motion
Charger: charging roller
Charging voltage: direct current voltage of positive polarity
Material of charging roller: epichlorohydrin rubber with an ion conductor dispersed therein
Diameter of charging roller: 12 mm
Thickness of rubber-containing layer of charging roller: 3 mm
Resistance of charging roller: 5.8 log Ω upon application of a charging voltage of +500 V
Distance between charging roller and circumferential surface of photosensitive member: 0 μm (contact)
Effective charge length: 226 mm
Transfer process: intermediate transfer process
Transfer voltage: direct current voltage of negative polarity
Material of transfer belt: polyimide
Transfer width: 232 mm
Static elimination light intensity: 5 $\mu J/cm^2$
Static elimination-charging time: 313 milliseconds for a photosensitive member linear velocity of 100 mm/second, 156 milliseconds for a photosensitive member linear velocity of 200 mm/second, and 104 milliseconds for a photosensitive member linear velocity of 300 mm/second
Cleaner: counter-contact cleaning blade
Contact angle of cleaning blade: 23 degrees
Material of cleaning blade: polyurethane rubber
Hardness of cleaning blade: 73
Rebound resilience of cleaning blade: 30%
Thickness of cleaning blade: 1.8 mm
Digging amount of cleaning blade in photosensitive member: 1.2 mm (Measurement Method of Static Elimination Light Intensity)

The static elimination light intensity of the evaluation apparatus was measured according to a method described below. An optical power meter ("OPTICAL POWER METER 3664", product of HIOKI E.E. CORPORATION) was embedded in a circumferential surface of the photosensitive member in a position opposite to a static elimination lamp. Static elimination light having a wavelength of 660 nm was irradiated onto the photosensitive member using the static elimination lamp, and the intensity of the static elimination light at the circumferential surface of the photosensitive member was measured using the optical power meter.

(Measurement Method of Transfer Charge Density)

The transfer charge density was measured according to a method described below. The photosensitive member was mounted in the evaluation apparatus. A toner was loaded into a toner container of the evaluation apparatus, and a developer containing the toner and a carrier was loaded into a development device of the evaluation apparatus. An image I was printed on a sheet of paper using the evaluation apparatus under environmental conditions of a temperature of 25° C. and a relative humidity of 50%. During the printing of the image I, the transfer current flowing through a primary transfer roller was measured using an ammeter/voltmeter ("MINIATURE PORTABLE AMMETER AND VOLTMETER 2051", product of Yokogawa Test & Measurement Corporation).

The printed image I was visually observed to confirm presence or absence of a ghost image thereon. The image I included an image region IA on a leading edge side of the paper and an image region IB on a trailing edge side of the paper in terms of a paper conveyance direction. The image region IA included a circular solid image portion and a background blank paper portion. The image region IA corresponded to an image region formed through the first rotation of the photosensitive member in formation of the image I. The image region IB included a halftone image portion. The image region IB corresponded to an image region formed through the second rotation of the photosensitive member in formation of the image I. The halftone image portion of the printed image I was visually observed to confirm presence or absence of a ghost image in the halftone image portion. Occurrence of a ghost image was confirmed if a ghost image (residual image) resulting from the circular solid image portion of the image I was observed in the halftone image portion of the image I.

Next, the transfer current, which was of negative polarity, of the primary transfer roller was gradually decreased to lower values (i.e., the absolute value of the transfer current was gradually increased to higher values), and the above-described printing was performed at each transfer current. During the printing, the transfer current flowing through the primary transfer roller was measured using the ammeter/voltmeter. The tendency of a ghost image to occur increases with a decrease in the transfer current value (i.e., with an increase in the absolute value of the transfer current). Accordingly, a highest transfer current $A_1$ among values of the transfer current each resulting in occurrence of a ghost image (i.e., a lowest absolute value of the transfer current among absolute values of the transfer current each resulting in occurrence of a ghost image) was determined. Based on the transfer current $A_1$ (unit: −A), the transfer width (unit: m), and the photosensitive member linear velocity (unit: m/second), a transfer charge density $D_2$ (unit: $-C/m^2$) was calculated in accordance with formula (3) shown below. The transfer charge density $D_2$ refers to a highest transfer charge density among the values of the transfer charge density each resulting in occurrence of a ghost image (i.e., a lowest absolute value of the transfer charge density among absolute values of the transfer charge density each resulting in occurrence of a ghost image).

$$D_2=(A_1)/(\text{transfer width}\times\text{photosensitive member linear velocity}) \quad (3)$$

The evaluation apparatus was set up as specified as each of conditions 1 to 5 shown below, and the transfer charge density $D_2$ was measured as described above under each condition. Note that a photosensitive member linear velocity of 300 mm/second is a sufficiently high printing speed that allows printing of 50 to 60 sheets of A4 paper per minute.

Condition 1: a photosensitive member linear velocity of 100 mm/second and static elimination light having a wavelength of 660 nm Condition 2: a photosensitive member linear velocity of 200 mm/second and static elimination light having a wavelength of 660 nm Condition 3: a photosensitive member linear velocity of 300 mm/second and static elimination light having a wavelength of 660 nm Condition 4: a photosensitive member linear velocity of 300 mm/second and static elimination light having a wavelength of 600 nm Condition 5: a photosensitive member linear velocity of 300 mm/second and static elimination light having a wavelength of 800 nm <Measurement Result of Transfer Charge Density>

Figure 9:
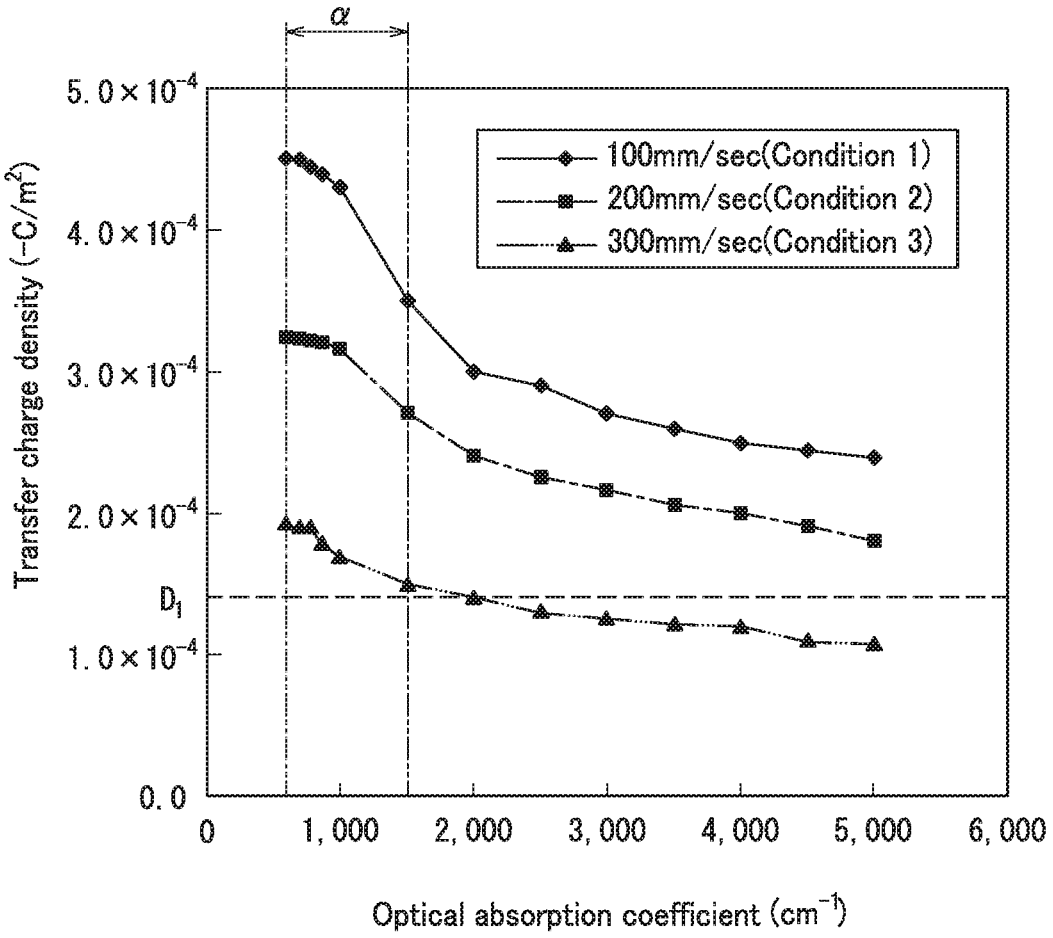
FIG. 9 is a graph representation illustrating a relationship between transfer charge density and optical absorption coefficient of a photosensitive layer of each of image bearing members.
Figure 10:
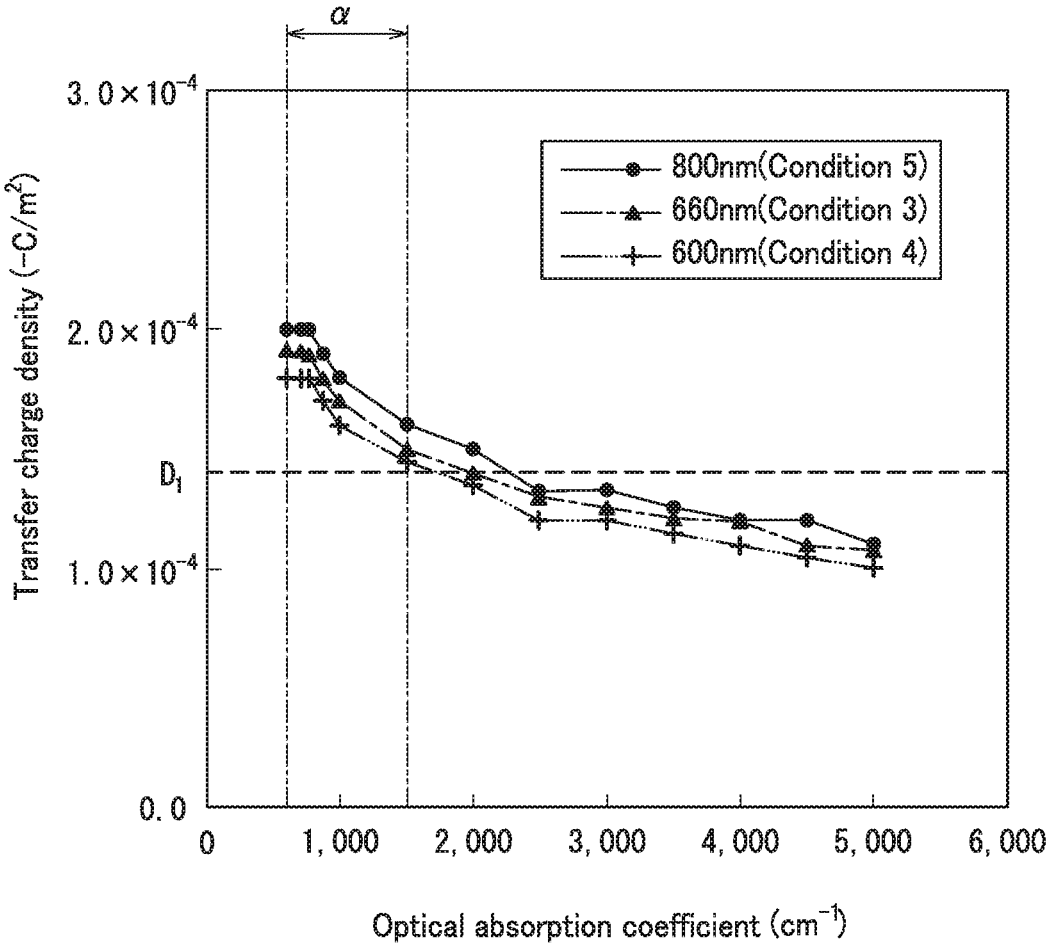
FIG. 10 is a graph representation illustrating a relationship between transfer charge density and optical absorption coefficient of the photosensitive layer of each of the image bearing members.

FIG. 9 shows results of the measurement of the transfer charge density $D_2$ under conditions 1 to 3. Specifically, diamonds, squares, and triangles on the plot in FIG. 9 represent the results of the measurement of the transfer charge density $D_2$ under conditions 1, 2, and 3, respectively. FIG. 10 shows results of the measurement of the transfer charge density $D_2$ under conditions 3 to 5. Specifically, triangles, crosses, and circles on the plot in FIG. 10 represent the results of the measurement of the transfer charge density $D_2$ under conditions 3, 4, and 5, respectively. The vertical axis in each of FIGS. 9 and 10 represents transfer charge density (unit: $-C/m^2$). The horizontal axis in each of FIGS. 9 and 10 represents optical absorption coefficient (unit: $cm^{-1}$) of the photosensitive layers of the photosensitive members. The value of the optical absorption coefficient of the photosensitive layer of each photosensitive member shown in FIGS. 9 and 10 corresponds to the value of the optical absorption coefficient of the photosensitive layer of the photosensitive member shown in Table 1. In FIGS. 9 and 10, "α" indicates a range of the optical absorption coefficient of from 600 $cm^{-1}$ to 1,500 $cm^{-1}$. "mm/sec" in FIG. 9 means "mm/second".

In FIGS. 9 and 10, "$D_1$" indicates a transfer charge density necessary for transferring the toner to the transfer belt ($-1.4\times10^{-1}$ $C/m^2$). Absolute values of the transfer charge density that are less than D, (below a dashed line denoted by $D_1$ in FIGS. 9 and 10) indicate that the toner was not transferred to the transfer belt, meaning poor toner transferring performance.

Absolute values of the transfer charge density that are greater than or equal to the measured transfer charge density $D_2$ (greater than or equal to the absolute value indicated by each mark on the plot in FIGS. 9 and 10) indicate that a ghost image occurred, meaning failure to inhibit occurrence of a ghost image.

Absolute values of the transfer charge density that are greater than or equal to $D_1$ and less than $D_2$ in FIGS. 9 and 10 (in a range of greater than or equal to the absolute value on the dashed line denoted by $D_1$ and below the absolute value of the transfer charge density $D_2$ indicated by each mark on the plot in FIGS. 9 and 10) indicate that occurrence of a ghost image was inhibited while toner transferring performance was ensured. The "range of greater than or equal to the absolute value on the dashed line denoted by $D_1$ and below the absolute value of the transfer charge density $D_2$ indicated by each mark on the plot" is also referred to below as a "pass range".

As shown in FIG. 9, the pass range, if any, of each photosensitive member narrowed with an increase in the linear velocity of the photosensitive member. A pass range was confirmed even under condition 3 (photosensitive member linear velocity: 300 mm/second), which was expected to result in the narrowest pass range among conditions 1 to 3, when the image forming apparatus included any of the photosensitive members having a photosensitive layer whose optical absorption coefficient was within the specified range (range α). By contrast, no pass range was confirmed under condition 3 (photosensitive member linear velocity: 300 mm/second) when the image forming apparatus included any of the photosensitive members having a photosensitive layer whose optical absorption coefficient was greater than 1,500 $cm^{-1}$. These results show that the image forming apparatus successfully inhibited occurrence of a ghost image while ensuring toner transferring performance when including any of the photosensitive members having a photosensitive layer whose optical absorption coefficient was within the specified range even if the linear velocity of the photosensitive member was high.

Furthermore, as shown in FIG. 9, a higher absolute value of the transfer charge density $D_2$ and a wider pass range were achieved when the image forming apparatus included any of the photosensitive members having a photosensitive layer whose optical absorption coefficient was within the specified range (range α) than when the image forming apparatus included any of the photosensitive members having a photosensitive layer whose optical absorption coefficient was greater than 1,500 $cm^{-1}$, provided that the photosensitive members had the same linear velocity. These results show that the transfer current setting range possible for the image forming apparatus to inhibit occurrence of a ghost image while ensuring toner transferring performance was wider when the image forming apparatus included any of the photosensitive members having a photosensitive layer whose optical absorption coefficient was within the specified range. Accordingly, the degree of transfer current setting freedom increased when the image forming apparatus included any of the photosensitive members having a photosensitive layer whose optical absorption coefficient was within the specified range.

FIG. 10 shows results of a study on the influence of the wavelength of the static elimination light from the static elimination lamp when the linear velocity of the photosensitive members was set to 300 mm/second, which was expected to result in the narrowest pass range. As shown in FIG. 10, a pass range was confirmed in all the cases of wavelengths of the static elimination light of 600 nm, 660 nm, and 800 nm when the image forming apparatus included any of the photosensitive members having a photosensitive layer whose optical absorption coefficient was within the specified range (range α). By contrast, no pass range was confirmed in at least one of the cases of wavelengths of the static elimination light of 600 nm, 660 nm, and 800 nm when the image forming apparatus included any of the photosensitive members having a photosensitive layer whose optical absorption coefficient was greater than 1,500 $cm^{-1}$. These results show that the image forming apparatus successfully inhibited occurrence of a ghost image while ensuring toner transferring performance when including any of the photosensitive members having a photosensitive layer whose optical absorption coefficient was within the specified range, provided that the wavelength of the static elimination light from the static elimination lamp was at least 600 nm and no greater than 800 nm.

Through the above, the image forming apparatus and the image forming method according to the present disclosure have been proven to be capable of inhibiting occurrence of a ghost image while ensuring toner transferring performance.

What is claimed is:

1. An image forming apparatus comprising:

an image bearing member; and a static elimination device configured to irradiate static elimination light onto a circumferential surface of the image bearing member, wherein the image bearing member includes a conductive substrate and a single-layer photosensitive layer, the single-layer photosensitive layer contains a charge generating material, a hole transport material, an electron transport material, and a binder resin, the static elimination light has a wavelength of at least 600 nm and no greater than 800 nm, the single-layer photosensitive layer has an optical absorption coefficient of at least 600 $cm^{-1}$ and no greater than 1,500 $cm^{-1}$ with respect to light having a wavelength of 660 nm, the charge generating material includes titanyl phthalocyanine, and the charge generating material is contained in an amount of at least 0.7% by mass and no greater than 1.8% by mass relative to mass of the single-layer photosensitive layer.

2. The image forming apparatus according to claim 1, wherein the hole transport material includes a compound represented by general formula (10), (10)

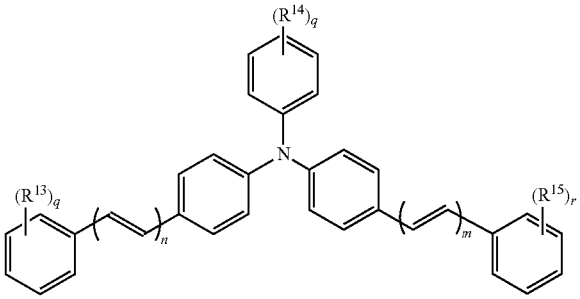

where in general formula (10), $R^{13}$ to $R^{15}$ each represent, independently of one another, an alkyl group having a carbon number of at least 1 and no greater than 4 or an alkoxy group having a carbon number of at least 1 and no greater than 4, m and n each represent, independently of one another, an integer of at least 1 and no greater than 3, p and r each represent, independently of one another, 0 or 1, and q represents an integer of at least 0 and no greater than 2.

3. The image forming apparatus according to claim 1, wherein the hole transport material includes a compound represented by chemical formula (HTM-1)

(HTM-1)

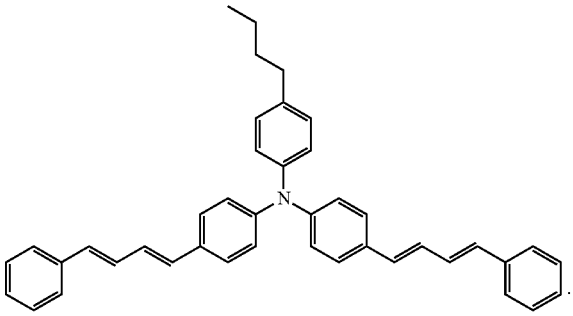

4. The image forming apparatus according to claim 1, wherein the binder resin includes a polyarylate resin including a repeating unit represented by general formula (20), (20)

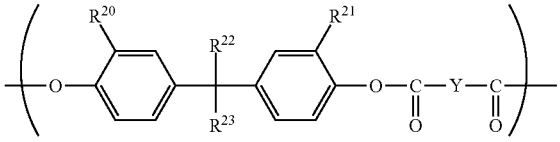

where in general formula (20), $R^{20}$ and $R^{21}$ each represent, independently of one another, a hydrogen atom or an alkyl group having a carbon number of at least 1 and no greater than 4, $R^{22}$ and $R^{23}$ each represent, independently of one another, a hydrogen atom, a phenyl group, or an alkyl group having a carbon number of at least 1 and no greater than 4, $R^{22}$ and $R^{23}$ may be bonded to one another to form a divalent group represented by general formula (W), and Y represents a divalent group represented by chemical formula (Y1), (Y2), (Y3), (Y4), (Y5), or (Y6), and (W)

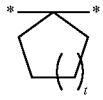

in general formula (W), t represents an integer of at least 1 and no greater than 3, and asterisks each represent a bond (Y1)

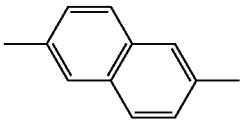

(Y2)

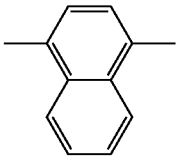

-continued (Y3)

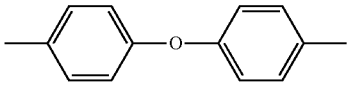

(Y4)

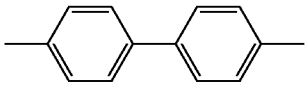

(Y5)

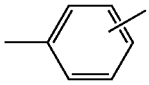

(Y6)

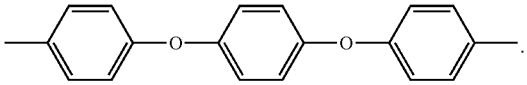

5. The image forming apparatus according to claim 1, wherein the binder resin includes a polyarylate resin having a main chain represented by general formula (20-1) and a terminal group represented by chemical formula (Z), (20-1)

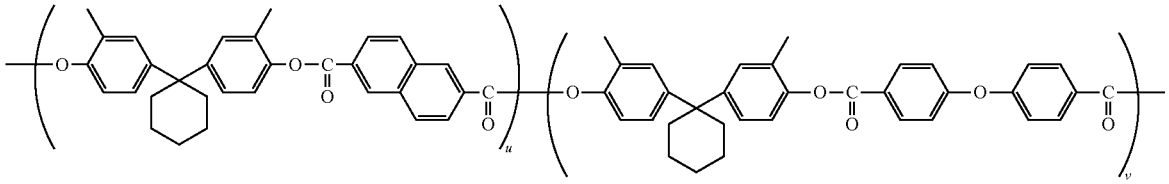

(Z)

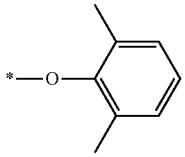

where in general formula (20-1), a sum of u and v is 100, and u is a number greater than or equal to 30 and less than or equal to 70, and in chemical formula (Z), an asterisk represents a bond.

6. The image forming apparatus according to claim 1, wherein the electron transport material includes both a compound represented by general formula (31) and a compound represented by general formula (32), (31)

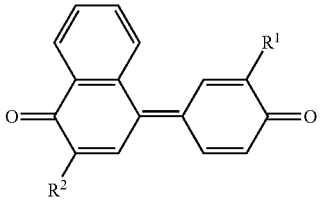

-continued (32)

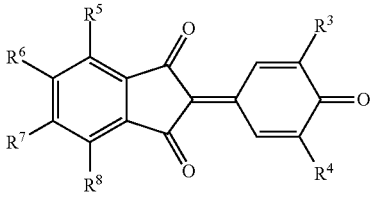

where in general formulae (31) and (32), $R^1$ to $R^4$ each represent, independently of one another, an alkyl group having a carbon number of at least 1 and no greater than 8, and $R^5$ to $R^8$ each represent, independently of one another, a hydrogen atom, a halogen atom, or an alkyl group having a carbon number of at least 1 and no greater than 4.

7. The image forming apparatus according to claim 1, wherein the electron transport material includes both a compound represented by chemical formula (ETM-1) and a compound represented by chemical formula (ETM-3)

(ETM-1)

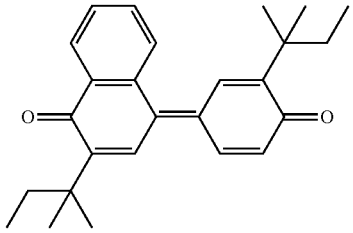

(ETM-3)

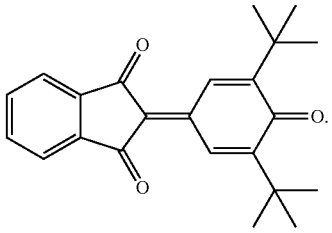

8. The image forming apparatus according to claim 1, wherein an intensity of the static elimination light upon arrival at the circumferential surface of the image bearing member after having been emitted from the static elimination device is at least 1 $\mu J/cm^2$ and no greater than 5 $\mu J/cm^2$.

9. The image forming apparatus according to claim 1, further comprising a charger located in contact with or adjacent to the circumferential surface of the image bearing member and configured to charge the circumferential surface of the image bearing member to a positive polarity.

10. The image forming apparatus according to claim 9, wherein a distance between the charger and the circumferential surface of the image bearing member is no greater than 50 μm.

11. A method for forming an image, comprising:

irradiating static elimination light onto a circumferential surface of an image bearing member, wherein the image bearing member includes a conductive substrate and a single-layer photosensitive layer, the single-layer photosensitive layer contains a charge generating material, a hole transport material, an electron transport material, and a binder resin, the static elimination light has a wavelength of at least 600 nm and no greater than 800 nm, the single-layer photosensitive layer has an optical absorption coefficient of at least 600 $cm^{-1}$ and no greater than 1,500 $cm^{-1}$ with respect to light having a wavelength of 660 nm, the charge generating material includes titanyl phthalocyanine, and the charge generating material is contained in an amount of at least 0.7% by mass and no greater than 1.8% by mass relative to mass of the single-layer photosensitive layer.

* * * * *